US011725557B2

(12) United States Patent
Saito et al.

(10) Patent No.: US 11,725,557 B2
(45) Date of Patent: Aug. 15, 2023

(54) ELECTRIC HEATING TYPE CARRIER AND EXHAUST GAS PURIFICATION DEVICE

(71) Applicant: NGK Insulators, Ltd., Nagoya (JP)

(72) Inventors: Hirotaka Saito, Komaki (JP); Naoki Yoshida, Ichinomiya (JP)

(73) Assignee: NGK INSULATORS, LTD., Nagoya (JP)

( * ) Notice: Subject to any disclaimer, the term of this patent is extended or adjusted under 35 U.S.C. 154(b) by 0 days.

(21) Appl. No.: 17/655,047

(22) Filed: Mar. 16, 2022

(65) Prior Publication Data

US 2022/0316379 A1 Oct. 6, 2022

(30) Foreign Application Priority Data

Mar. 31, 2021 (JP) ..... JP2021-061939
Feb. 4, 2022 (JP) ..... JP2022-016551

(51) Int. Cl.
*F01N 3/20* (2006.01)
*F01N 3/28* (2006.01)

(52) U.S. Cl.
CPC ..... *F01N 3/2026* (2013.01); *F01N 3/281* (2013.01); *F01N 2240/16* (2013.01); *F01N 2330/02* (2013.01); *F01N 2330/30* (2013.01)

(58) Field of Classification Search
CPC ..... F01N 2240/16; F01N 2330/02; F01N 2330/30; F01N 3/2026; F01N 3/281
See application file for complete search history.

(56) References Cited

U.S. PATENT DOCUMENTS

| | | | | |
|---|---|---|---|---|
| 10,655,526 | B1 * | 5/2020 | Okamoto | F01N 13/1838 |
| 2014/0294687 | A1 | 10/2014 | Mase et al. | |
| 2014/0294688 | A1 | 10/2014 | Mase et al. | |
| 2019/0299200 | A1 | 10/2019 | Takase | |
| 2019/0299201 | A1 | 10/2019 | Takase | |
| 2019/0299202 | A1 * | 10/2019 | Ikoma | F01N 3/2026 |

FOREIGN PATENT DOCUMENTS

| | | | |
|---|---|---|---|
| JP | 2014-198321 | A | 10/2014 |
| JP | 2014-198446 | A | 10/2014 |
| JP | 2019-173662 | A | 10/2019 |
| JP | 2019-173663 | A | 10/2019 |

* cited by examiner

*Primary Examiner* — Anthony Ayala Delgado
(74) *Attorney, Agent, or Firm* — Burr Patent Law, PLLC

(57) ABSTRACT

An electric heating type carrier including a conductive honeycomb structure portion and a pair of electrode layers, wherein in a cross-section orthogonal to the direction in which the cells extend, the honeycomb structure portion is classified into following three regions: a first resistance region having a contact portion with a first electrode layer, a second resistance region having a contact portion with a second electrode layer, and a third resistance region that does not come into contact with either the first electrode layer or the second electrode layer, and traverses the cross-section so as to be sandwiched between the first resistance region and the second resistance region, and has a higher electrical resistance per unit volume (1 $cm^3$) than an electrical resistance per unit volume (1 $cm^3$) of the first resistance region and the second resistance region.

11 Claims, 7 Drawing Sheets

ELECTRIC HEATING TYPE CARRIER AND EXHAUST GAS PURIFICATION DEVICE

CROSS REFERENCE TO RELATED APPLICATIONS

The present invention claims the benefit of priorities to Japanese Patent Applications No. 2021-061939 filed on Mar. 31, 2021 and No. 2022-016551 filed on Feb. 4, 2022 with the Japanese Patent Office, the entire contents of which are incorporated herein by reference in its entirety.

FIELD OF THE INVENTION

The present invention relates to an electric heating type carrier. The present invention also relates to an exhaust gas purification device using an electric heating type carrier.

BACKGROUND OF THE INVENTION

In recent years, an electric heating catalyst (EHC) having a honeycomb structure has been proposed in order to suppress the deterioration of exhaust gas purification performance at the time immediately after starting an engine. Generally, the EHC comprises a conductive honeycomb structure portion having an outer peripheral wall and partition walls that are disposed inside the outer peripheral wall and partition a plurality of cells forming flow paths from one end surface to the other end surface, and a pair of electrode layers arranged on the outer peripheral wall of the honeycomb structure. In the EHC, it is desired to control the temperature distribution within the honeycomb structure, and various techniques have been developed.

In Patent Literature 1 (Japanese Patent Application Publication No. 2014-198321), it is described that a honeycomb structure portion is composed of an outer peripheral region having a side surface and a central region which is a region at the center excluding the outer peripheral region, and that the electrical resistivity of the material constituting the outer peripheral region is lower than the electrical resistivity of the material constituting the central region. By making the electrical resistivity of the outer peripheral region lower than the electrical resistivity of the central region, it is described that when a voltage is applied to the honeycomb structure, the current from the electrodes easily flows to the honeycomb structure (the carrier), so that the honeycomb structure is easily heated uniformly.

In Patent Literature 2 (Japanese Patent Application Publication No. 2014-198446), it is described that a honeycomb structure portion is composed of an outer peripheral region having a side surface and a central region which is a region at the center excluding the outer peripheral region, and that the electrical resistivity of the central region is lower than the electrical resistivity of the outer peripheral region. According to this configuration, since the electrical resistivity of the central region is lower than the electrical resistivity of the outer peripheral region, it is described that when a voltage is applied to the honeycomb structure, a larger amount of current flows in the inlet side region, so that the current flowing by applying the voltage can be effectively used for treating the substance to be treated in the exhaust gas.

In Patent Literature 3 (Japanese Patent Application Publication No. 2019-173663), it is described that a honeycomb structure portion is composed of an outer peripheral region having a side surface, a central region which is a region at the center, and an intermediate region excluding the outer peripheral region and the central region, and that the average electrical resistivity A of the material constituting the outer peripheral region, the average electrical resistivity B of the material constituting the central region, and the average electrical resistivity C of the material constituting the intermediate region satisfy the relationship of $A \leq B < C$. According to this configuration, it is described that heat generation uniformity of the honeycomb structure is improved.

In Patent Literature 4 (Japanese Patent Application Publication No. 2019-173662), it is described that a honeycomb structure portion is composed of end regions near a pair of electrode portions and a central region excluding the end regions, and that the average electrical resistivity A of the material constituting the end regions is lower than the average electrical resistivity B of the material constituting the central region. According to this configuration, it is described heat generation uniformity of the honeycomb structure is improved.

PRIOR ART

Patent Literature

[Patent Literature 1] Japanese Patent Application Publication No. 2014-1983321

[Patent Literature 1] Japanese Patent Application Publication No. 2014-198446

[Patent Literature 1] Japanese Patent Application Publication No. 2019-173663

[Patent Literature 1] Japanese Patent Application Publication No. 2019-173662

SUMMARY OF THE INVENTION

As described above, various techniques for controlling the temperature distribution of the honeycomb structure portion have been proposed. However, there is still room for improvement in the heat generation uniformity within the honeycomb structure portion. In the technique described in Patent Literature 1, since the electrical resistivity of the outer peripheral region is lower than the electrical resistivity of the central region, a current tends to flow in the outer peripheral region and the temperature in the outer peripheral region tends to increase. The technique described in Patent Literature 2 does not aim at heat generation uniformity, and the temperature in the vicinity of the electrodes rises. Also, in the technique described in Patent Literature 3, since the average electrical resistivity A of the material constituting the outer peripheral region is low, the current tends to flow in the outer peripheral region, and the temperature of the outer peripheral region tends to increase as well. In the technique described in Patent Literature 4, the current is concentrated in the end regions near the pair of electrode portions, and the current is difficult to spread to the left and right, and as a result, in the cross-section orthogonal to the direction in which the cells extend, the temperature of the outer peripheral portion which is away from the region sandwiched between the pair of electrode portions tends to be low.

The present invention has been created in view of the above circumstances, and one embodiment of the present invention is aiming at providing an electric heating type carrier having improved heat generation uniformity. Another embodiment of the present invention is aiming at providing an exhaust gas purification device including such an electric heating type carrier.

The above problems have been solved by the present invention, which is exemplified as below.

[1] An electric heating type carrier, comprising:

a conductive honeycomb structure portion having an outer peripheral wall and partition walls that are disposed inside the outer peripheral wall and partition a plurality of cells forming flow paths from one end surface to the other end surface;

a first electrode layer provided in a band shape in a direction in which the cells extend on a surface of the outer peripheral wall; and a second electrode layer provided in a band shape in a direction in which the cells extend on the surface of the outer peripheral wall, the second electrode layer provided so as to oppose the first electrode layer with a central axis of the honeycomb structure portion interposed therebetween;

wherein in a cross-section orthogonal to the direction in which the cells extend, the honeycomb structure portion is classified into three regions of:

a first resistance region having a contact portion with the first electrode layer, a second resistance region having a contact portion with the second electrode layer, and a third resistance region that does not come into contact with either the first electrode layer or the second electrode layer, and traverses the cross-section so as to be sandwiched between the first resistance region and the second resistance region; and the third resistance region has a higher electrical resistance per unit volume (1 $cm^3$) than an electrical resistance per unit volume (1 $cm^3$) of the first resistance region and the second resistance region.

[2] An exhaust gas purification device, comprising the electric heating type carrier according to [1], and a tubular metal tube accommodating the electric heating type carrier.

According to one embodiment of the present invention, it is possible to provide an electric heating type carrier having improved heat generation uniformity. As a result, the temperature difference in the honeycomb structure portion can be reduced, so that the occurrence of cracks can be suppressed. This electric heating type carrier can be used, for example, as a catalyst carrier for an exhaust gas purification device.

DETAILED DESCRIPTION OF THE INVENTION

Hereinafter, embodiments of the present invention will now be described in detail with reference to the drawings. It should be understood that the present invention is not intended to be limited to the following embodiments, and any change, improvement or the like of the design may be appropriately added based on ordinary knowledge of those skilled in the art without departing from the spirit of the present invention.

(1. Electric Heating Type Carrier)

Figure 1A:
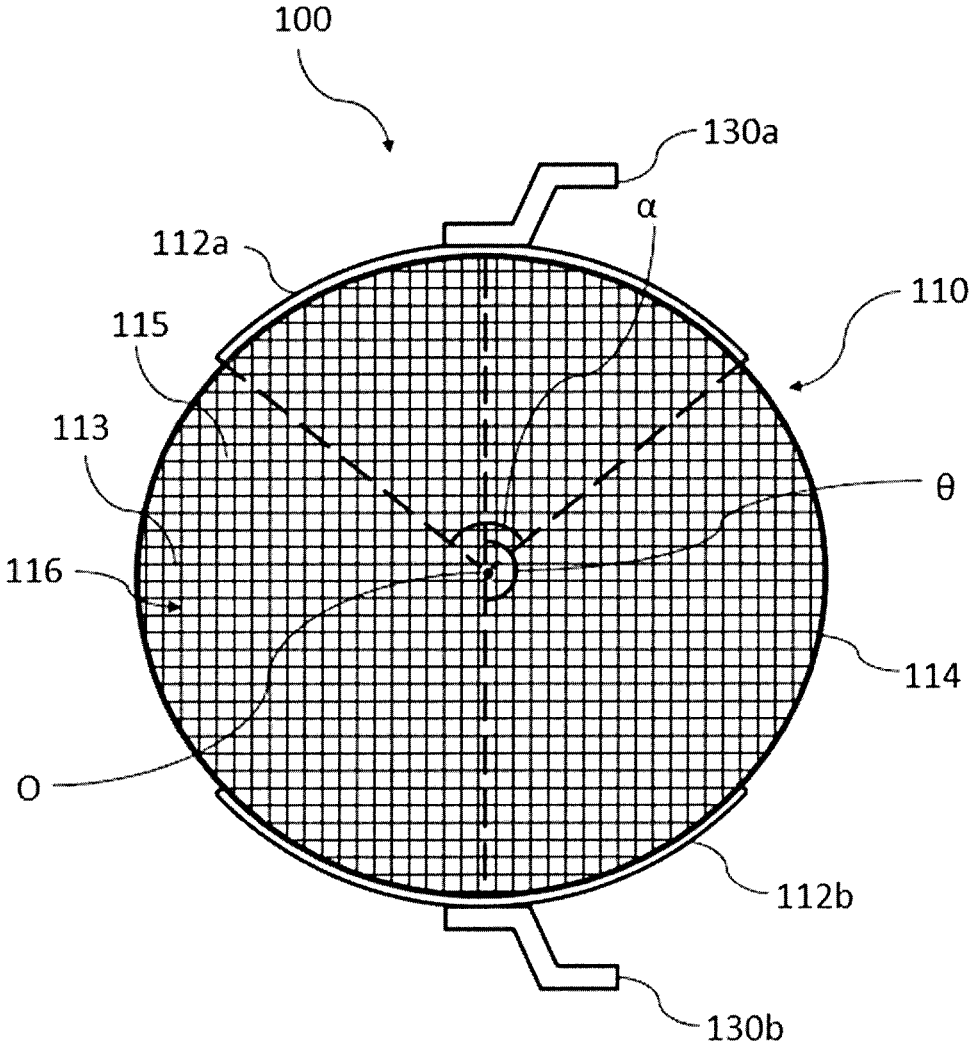
FIG. 1A is a schematic view of an electric heating type carrier according to an embodiment of the present invention when observed from one end surface.
Figure 1B:
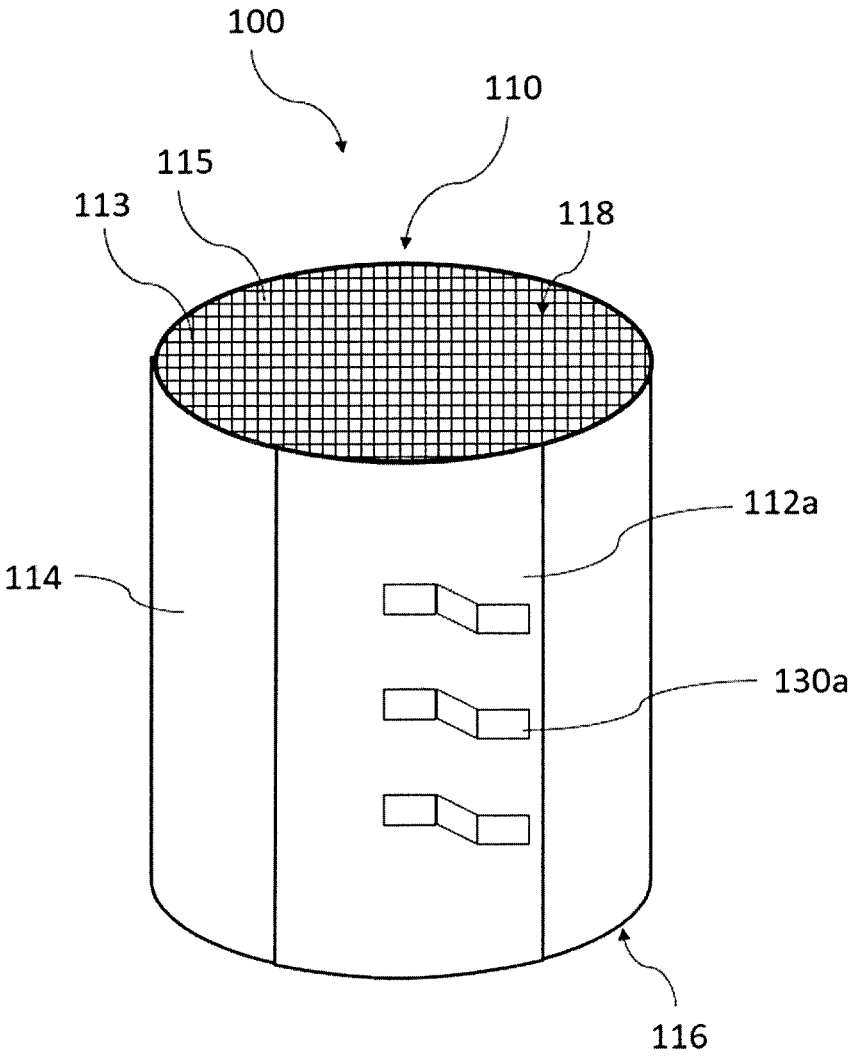
FIG. 1B is a schematic perspective view of an electric heating type carrier according to one embodiment of the present invention.

FIG. 1A is a schematic view of an electric heating type carrier 100 according to one embodiment of the present invention when observed from one end surface 116. FIG. 1B is a schematic perspective view of an electric heating type carrier 100 according to one embodiment of the present invention.

The electric heating type carrier 100 comprises:

a conductive honeycomb structure portion 110 having an outer peripheral wall 114 and partition walls 113 that are disposed inside the outer peripheral wall 114 and partition a plurality of cells 115 forming flow paths from one end surface 116 to the other end surface 118;

a first electrode layer 112*a* provided in a band shape in a direction in which the cells 115 extend on a surface of the outer peripheral wall 114; and a second electrode layer 112*b* provided in a band shape in a direction in which the cells 115 extend on the surface of the outer peripheral wall 114, the second electrode layer 112*b* provided so as to oppose the first electrode layer 112*a* with a central axis O of the honeycomb structure portion 110 interposed therebetween.

By carrying a catalyst on the electric heating type carrier 100, the electric heating type carrier 100 may be used as a catalyst body. A fluid such as automobile exhaust gas can flow through the plurality of cells 115. Examples of the catalyst include noble metal-based catalysts and catalysts other than these. As the noble metal-based catalysts, examples include a three-way catalyst or an oxidation catalyst that carry noble metals such as platinum (Pt), palladium (Pd), and rhodium (Rh) on the surface of alumina pores and contains co-catalysts such as ceria and zirconia, and alternatively, a $NO_x$ storage reduction catalyst (LNT catalyst) containing an alkaline earth metal and platinum as storage components for nitrogen oxides ($NO_x$). As catalysts that do not use noble metals, examples include $NO_x$ selective reduction catalysts (SCR catalysts) containing copper-substituted or iron-substituted zeolites. Further, two or more kinds of catalysts selected from these catalysts may be used. The method of carrying the catalyst is also not particularly limited, and can be carried out according to a conventional method for carrying a catalyst on a honeycomb structure.

(1-1. Honeycomb Structure Portion)

The honeycomb structure portion 110 has an outer peripheral wall 114 and partition walls 113 that are disposed inside the outer peripheral wall 114 and partition a plurality of cells 115 forming flow paths from one end surface 116 to the other end surface 118. The honeycomb structure portion 110 is a conductive pillar-shaped member. The pillar shape can be understood as a three-dimensional shape having a thickness in the direction in which the cells extend (axial direction of the honeycomb structure portion). The ratio (aspect ratio) between the axial length of the honeycomb structure portion and the diameter or width of the end surface of the honeycomb structure portion is arbitrary. The pillar shape may also include a shape in which the axial length of the honeycomb structure portion is shorter than the diameter or width of the end surface (a flat shape).

The outer shape of the honeycomb structure portion 110 can be, for example, a pillar shape having circular end surfaces (a cylindrical shape), a pillar shape having an oval-shaped end surface, and a pillar shape having a polygonal end surface (a quadrangle, a pentagon, a hexagon, a heptagon, an octagon, and the like). Further, the area of an end surface is preferably 2000 to 20000 $mm^2$, more preferably 5000 to 15000 $mm^2$, for the reason of enhancing heat resistance (suppressing cracks occurring in the peripheral direction of the outer peripheral wall).

The height of the honeycomb structure portion 110 (the length from one end surface 116 to the other end surface 118) is not particularly limited, and may be appropriately set according to the application and required performance.

Providing the outer peripheral wall 114 in the honeycomb structure portion 110 is useful from the viewpoint of ensuring the structural strength of the honeycomb structure portion 110 and suppressing the fluid flowing through the cells 115 from leaking from the outer peripheral wall 114. In this respect, the thickness of the outer peripheral wall 114 is preferably 0.1 mm or more, more preferably 0.15 mm or more, and even more preferably 0.2 mm or more. However, if the outer peripheral wall 114 is made too thick, the strength becomes too high so that the strength balance with the partition walls 113 is lost, and the thermal shock resistance is lowered. Therefore, the thickness of the outer peripheral wall 114 is preferably 1.0 mm or less. more preferably 0.7 mm or less, and even more preferably 0.5 mm or less. Here, the thickness of the outer peripheral wall 114 is defined as the thickness in the normal direction with respect to a tangential line of the outer surface of the outer peripheral wall 114 at the measurement point when observing the location of the outer peripheral wall 114 for which the thickness is to be measured in a cross-section perpendicular to the direction in which the cells 115 extend.

The outer peripheral wall 114 and the partition walls 113 have higher volume resistivity than the electrode layers 112*a* and 112*b*, but have conductivity. The volume resistivity of the outer peripheral wall 114 and the partition walls 113 is not particularly limited as long as they can be energized and generate heat by Joule heat, but it is preferably 0.1 to 200 Ωcm, more preferably 1 to 200 Ωcm, and even more preferably 10 to 100 Ωcm.

Figure 2:
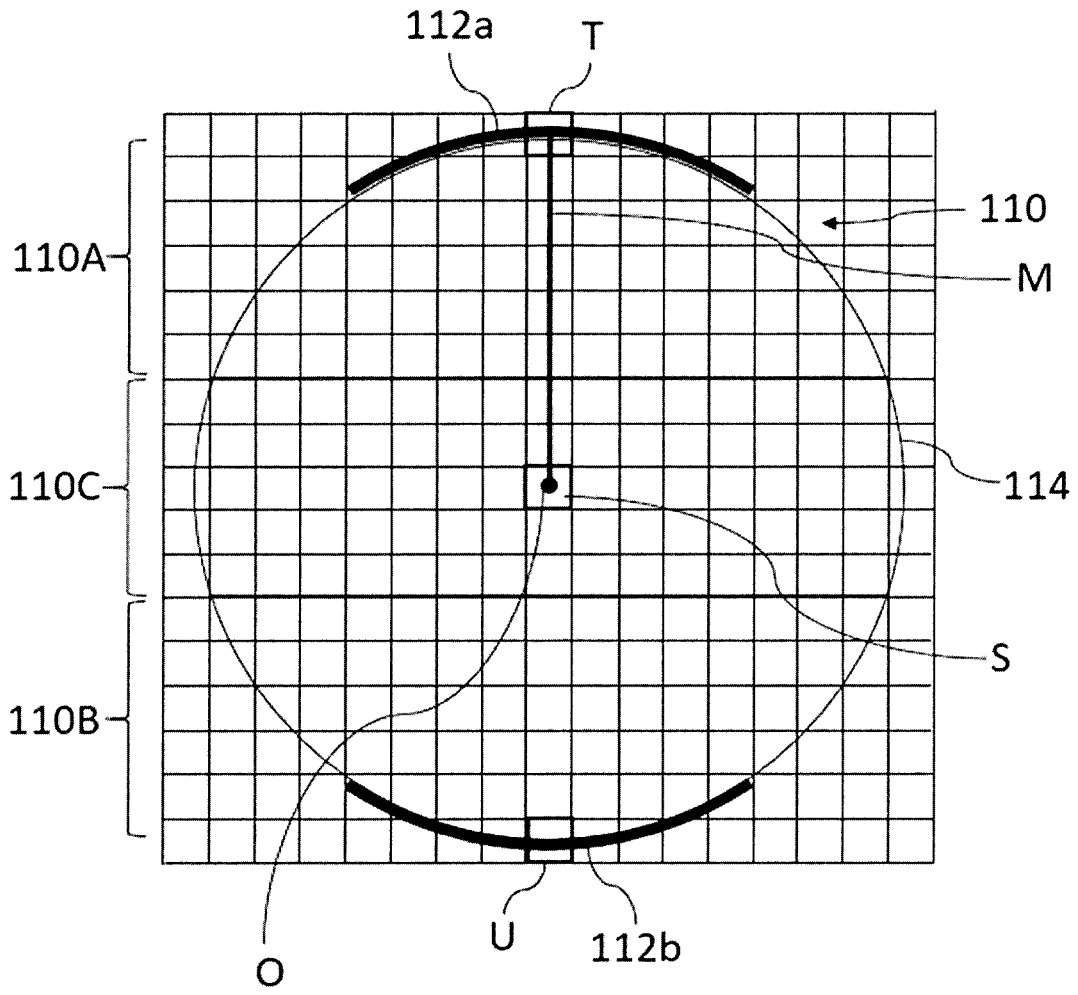
FIG. 2 is a schematic diagram for explaining a method of specifying each resistance region in a cross-section orthogonal to the direction in which the cells extend of the electric heating type carrier according to one embodiment of the present invention.

Referring to FIG. 2, the honeycomb structure portion 110 can be classified into the following three regions in a cross-section orthogonal to the direction in which the cells 115 extend. Further, it is preferable that the honeycomb structure portion 110 is classified into the following three regions in any cross-section orthogonal to the direction in which the cells 115 extend.

a first resistance region 110A having a contact portion with the first electrode layer 112*a*, a second resistance region 110B having a contact portion with the second electrode layer 112*b*, and a third resistance region 110C that does not come into contact with either the first electrode layer 112*a* or the second electrode layer 112*b*, and traverses the cross-section so as to be sandwiched between the first resistance region 110A and the second resistance region 110B, and has a higher electrical resistance per unit volume (1 $cm^3$) than an electrical resistance per unit volume (1 $cm^3$) of the first resistance region 110A and the second resistance region 110B.

Although the present invention is not intended to be limited by any theory, a presumed mechanism for improving heat generation uniformity in the honeycomb structure portion 110 according to the present embodiment will be discussed. First, when the electrical resistance in the honeycomb structure portion 110 is constant regardless of the location, while the temperature in the vicinity of the first electrode layer 112*a* and the second electrode layer 112*b*, which are the inlets and outlets of the current, increases, the temperature in the vicinity of the center of the honeycomb structure portion tends to be low. Further, the temperature of the outer peripheral portion which is away from the region sandwiched between the first electrode layer 112*a* and the second electrode layer 112*b* tends to be low.

On the other hand, in the case in which the honeycomb structure portion 110 has the first resistance region 110A, the second resistance region 110B, and the third resistance region 110C, the third resistance region having a relatively high electric resistance has no portion in contact with either the first electrode layer 112*a* or the second electrode layer 112*b*. That is, since the first resistance region 110A and the second resistance region 110B having low electric resistance are in contact with the first electrode layer 112*a* and the second electrode layer 112*b*, respectively, excessive heat generation in the vicinity of the first electrode layer 112*a* and the second electrode layer 112*b* is suppressed. On the other hand, since the third resistance region 110C including the central axis O of the honeycomb structure portion 110 has a high electric resistance, if the amount of current is the same, the amount of heat generated will be larger. This improves heat generation uniformity.

Further, since the third resistance region 110C traverses the cross-section of the honeycomb structure portion 110, for example, when a voltage is applied between the first electrode layer 112*a* on the positive electrode side and the second electrode layer 112*b* on the negative electrode side, the current flowing from the first electrode layer 112*a* to the second electrode layer 112*b* always passes through the third resistance region 110C having a higher electric resistance. That is, in the honeycomb structure portion 110 according to the present embodiment, since there is no escape route to the outer peripheral portion for the current, the current can flow in both the outer peripheral portion and the central portion with high uniformity.

Therefore, according to the honeycomb structure portion 110 according to the present embodiment, the heat generation uniformity when a voltage is applied between the first electrode layer 112*a* and the second electrode layer 112*b* is improved.

In addition, the same can be said as above even if a voltage is applied between the first electrode layer 112*a* on the negative electrode side and the second electrode layer 112*b* on the positive electrode side.

The electrical resistance per unit volume (1 $cm^3$) of each resistance region is measured at room temperature (25° C.) according to a four-terminal method.

In the cross-section orthogonal to the direction in which the cells 115 extend, the first resistance region 110A, the second resistance region 110B, and the third resistance region 110C can be specified as follows. First, a line segment M is drawn from the central axis O of the cross-section toward the center in the peripheral direction of either the first electrode layer 112*a* or the second electrode layer 112*b*. Next, a square S having an area of 1 $cm^2$ with a pair of sides parallel to the line segment M is drawn with the central axis O as the center of gravity. Next, eight squares having an area of 1 $cm^2$ adjacent to the square S and sharing one side with the square S are drawn. Next, squares with an area of 1 $cm^2$ sharing one side with each of these eight squares are drawn adjacently. By repeating this, the cross-section is divided into squares having an area of 1 $cm^2$. FIG. 2 shows a schematic diagram when the honeycomb structure portion 110 is divided by a large number of squares having an area of 1 $cm^2$ adjacent to each other.

For each of 1 $cm^2$ squares that divides the cross-section, a 3 $cm^3$ rectangular parallelepiped sample with a depth of 3 cm is taken, and the electrical resistance of the rectangular parallelepiped sample is measured by the method described above, and then the electrical resistance per 1 $cm^3$ is calculated. There may be locations of the outer peripheral portion from which a 3 $cm^3$ rectangular parallelepiped cannot be taken, for such locations, a sample is taken within a range that is possible, and the electric resistance of the sample is measured according to the method described above, and the electric resistance is converted into the electric resistance per 1 $cm^3$ by the volume ratio. In addition, if the electrical resistance of the sample is known or apparent, it is not necessary to take the sample.

By the above procedure, the electric resistance per 1 $cm^3$ of each section is obtained when the cross-section of the honeycomb structure portion 110 is divided into 1 $cm^2$ square sections. Next, an electrode layer having an intersection with the line segment M is set as the first electrode layer 112*a*, and a section of the square T including the surface point of the outer peripheral wall 114 in contact with the center of the first electrode layer 112*a* in the peripheral direction is specified. Assuming the electrical resistance per 1 $cm^3$ of the square T section (excluding the electrode layer) is $R_T$, a set of square sections of the honeycomb structure portion continuous from the square T section and having an electrical resistance in the range of $R_T \times 0.6$ or more and less than $R_T \times 1.1$ is defined as the first resistance region 110A.

Further, in the above cross-section, a square U including a surface point of the outer peripheral wall 114 in contact with the center of the second electrode layer 112*b* in the peripheral direction which opposes the first electrode layer 112*a* is specified. A set of square sections of the honeycomb structure portion continuous from the square U section and having an electrical resistance in the range of $R_T \times 0.6$ or more and less than $R_T \times 1.1$ is defined as the second resistance region 110B. Note that the reference of the electric resistance used to specify the second resistance region 110B is $R_T$, not the electric resistance per 1 $cm^3 R_U$ of the square U section (excluding the electrode layer).

Further, in the above cross-section, a region that does not come into contact with either the first electrode layer 112*a* or the second electrode layer 112*b* and traverses the cross-section is specified so as to be sandwiched between the first resistance region 110A and the second resistance region 110B. When the electric resistance of each section of the honeycomb structure portion included in this region is always $R_T \times 1.1$ or more, the region can be defined as the third resistance region.

The method for relatively increasing the electric resistance per unit volume (1 $cm^3$) in the third resistance region 110C is not limited, but for example, a method of making the thickness of the partition walls 113 in the third resistance region 110C thinner than the thickness of the partition walls of the first resistance region 110A and the second resistance region 110B can be mentioned. Such a partition wall structure can be realized by designing a die structure used when the honeycomb structure portion is subjected to extrusion molding such that a desired partition wall thickness can be obtained in each resistance region. Further, it is also conceivable to provide a slit(s) formed by lacking a part of the partition wall 113 of the third resistance region 110C. Such a partition wall structure can also be realized by designing a die structure used when the honeycomb structure portion is subjected to extrusion molding such that a slit(s) are formed by lacking a part of the partition walls in the third resistance region 110C.

It is desirable that the electric resistance per unit volume (1 $cm^3$) of the plurality of sections of the honeycomb structure portion constituting the first resistance region 110A and the second resistance region 110B have less fluctuation. This is because, in the first resistance region 110A and the second resistance region 110B, if there is a large fluctuation in the electric resistance within the same resistance region, the current flow is biased and the effect of improving the heat generation uniformity is reduced. Specifically, in the above cross-section, the ratio of the maximum value $R_{max}$ to the minimum value $R_{min}$ of the electric resistance per unit volume (1 $cm^3$) of the plurality of square sections constituting each resistance region of the first resistance region 110A and the second resistance region 110B preferably satisfies $1.0 \leq R_{max}/R_{min} \leq 2$, more preferably satisfies $1.0 \leq R_{max}/R_{min} \leq 1.6$, and even more preferably satisfies $1.0 \leq R_{max}/R_{min} \leq 1.3$.

Regarding the third resistance region 110C as well, a large fluctuation in the electrical resistance within the region may lead to a decrease in the effect of improving the heat generation uniformity. Therefore, in the above cross-section, the ratio of the maximum value $R_{max}$ to the minimum value $R_{min}$ of the electric resistance per unit volume (1 $cm^3$) of the plurality of square sections constituting the third resistance region 110C preferably satisfies $1.0 \leq R_{max}/R_{min} \leq 2$, more preferably satisfies $1.0 \leq R_{max}/R_{min} \leq 1.6$, and even more preferably satisfies $1.0 \leq R_{max}/R_{min} \leq 1.3$.

Figure 3:
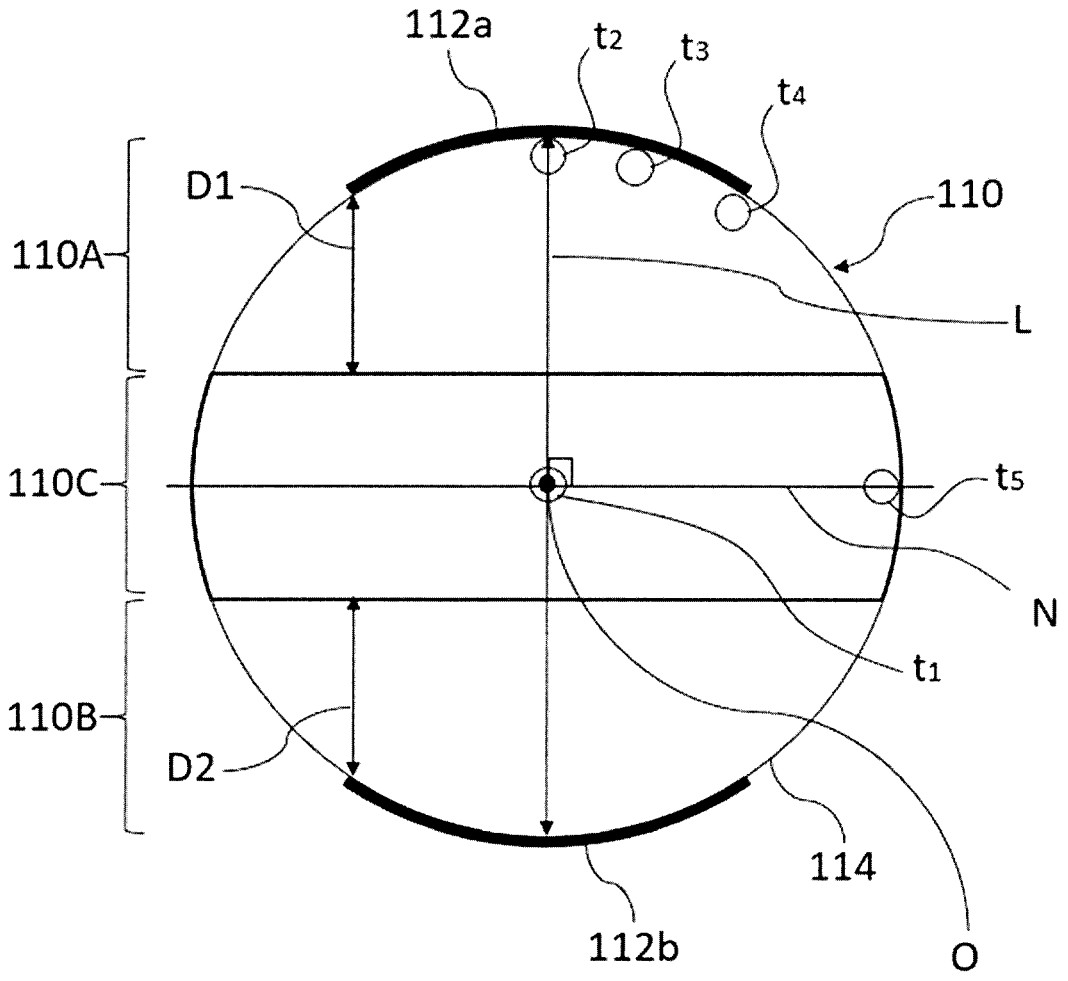
FIG. 3 is a schematic diagram showing an example of arrangement of each resistance region in a cross-section orthogonal to the direction in which the cells extend of the electric heating type carrier according to one embodiment of the present invention.

FIG. 3 shows a schematic diagram showing an arrangement example of each resistance region (110A, 110B, 110C) in a cross-section orthogonal to the direction in which the cells extend according to the electric heating type carrier of the present invention in one embodiment. In the embodiment shown in FIG. 3, when the cross-section orthogonal to the direction in which the cells extend is observed such that the first electrode layer 112*a* is located on the upper side and the second electrode layer 112*b* is located on the lower side, the third resistance region 110C traverses the cross-section orthogonal to the direction in which the cells extend from right to left so as to be sandwiched between the first resistance region 110A and the second resistance region 110B. Further, the third resistance region 110C is formed in a band shape having a constant width in the vertical direction. In this case, assuming that the electric resistance per unit volume (1 $cm^3$) of the plurality of square sections forming the third resistance region 110C is constant, compared with the vicinity of the central axis O, the amount of current in the outer peripheral portion of the honeycomb structure portion 110 is smaller, and the amount of heat generated tends to be smaller.

Figure 4:
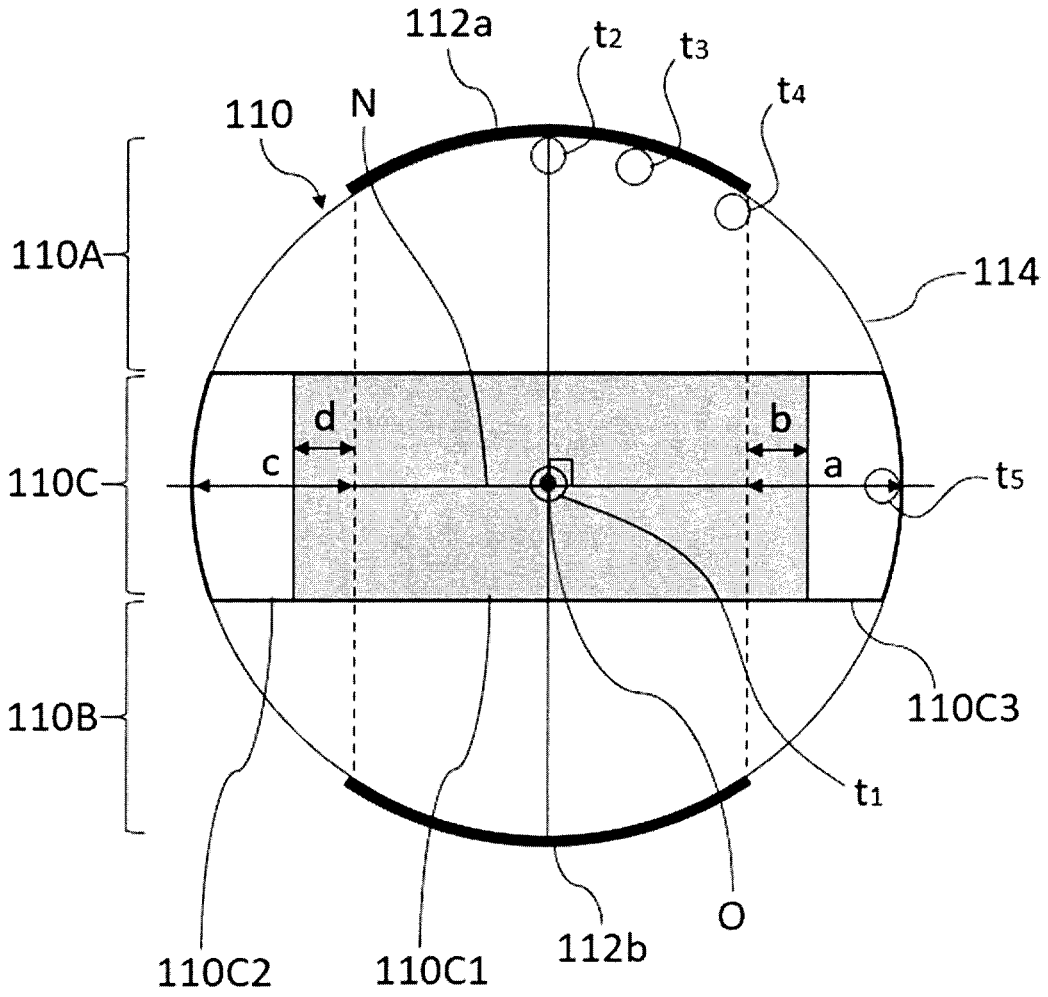
FIG. 4 is a schematic diagram showing an example of arrangement of each resistance region in a cross-section orthogonal to the direction in which the cells extend of the electric heating type carrier according to another embodiment of the present invention.

Therefore, in the third resistance region 110C, it is preferable to increase the amount of current in the outer peripheral portion to increase the amount of heat generated in the outer peripheral portion and further improve the heat generation uniformity. As a method of increasing the amount of current in the outer peripheral portion in the third resistance region 110C, a method of lowering the electric resistance per unit volume (1 $cm^3$) in the area of the third resistance region 110C corresponding to the outer peripheral portion of the honeycomb structure portion 110 can be mentioned. FIG. 4 is a schematic diagram showing the arrangement of each resistance region (110A, 110B, 110C) in the cross-section orthogonal to the direction in which the cells extend according to the electric heating type carrier of the present invention in another embodiment.

In the embodiment shown in FIG. 4, when the cross-section orthogonal to the direction in which the cells extend is observed such that the first electrode layer 112*a* is located on the upper side and the second electrode layer 112*b* is located on the lower side, the third resistance region 110C is classified into three regions of:

- a central portion 110C1 comprising the central axis O of the honeycomb structure portion 110,
- a left side portion 110C2 adjacent to a left end of the central portion 110C1 and extending to a left end of the third resistance region 110C and having a lower electrical resistance per unit volume (1 $cm^3$) than the central portion 110C1, and
- a right side portion 110C3 adjacent to a right end of the central portion 110C1 and extending to a right end of the third resistance region 110C and having a lower electrical resistance per unit volume (1 $cm^3$) than the central portion 110C1.

The distinction between the central portion 110C1 and the left side portion 110C2, and the distinction between the central portion 110C1 and the right side portion 110C3 can be specified as follows. First, the third resistance region 110C is specified by the procedure described above. Next, the electric resistance per 1 $cm^3$ corresponding to the square S described above is set as the reference resistance, and in the third resistance region 110C, the above-mentioned sections having an electric resistance of 90% or less with respect to the reference resistance is specified as a low resistance region. The other sections forming the third resistance region 110C are specified as high resistance regions. Then, when the low resistance region and the high resistance region are arranged in the order of low resistance region=>high resistance region=>low resistance region from the left side to the right side as shown in FIG. 4, the low resistance region on the left side can be defined as the left side portion 110C2, the high resistance region in the center can be defined as the central portion 110C1, and the low resistance region on the right side can be defined as the right side portion 110C3.

The ratio of the average value of electrical resistance per unit volume (1 $cm^3$) of the central portion 110C1 to the average value of electrical resistance per unit volume (1 $cm^3$) of the left side portion 110C2 is preferably 1.15 to 4, and more preferably 1.15 to 2.

The ratio of the average value of electrical resistance per unit volume (1 $cm^3$) of the central portion 110C1 to the average value of electrical resistance per unit volume (1 $cm^3$) of the right side portion 110C3 is preferably 1.15 to 4, and more preferably 1.15 to 2.

The ratio of the average value of electrical resistance per unit volume (1 $cm^3$) of the right side 110C3 to the average value of electrical resistance per unit volume (1 $cm^3$) of the left side 110C2 is preferably 0.8 to 1.2, more preferably 0.9 to 1.1. It is particularly preferable that the average value of the electric resistance per unit volume of the left side portion 110C2 and the right side portion 110C3 is approximately the same.

Figure 5:
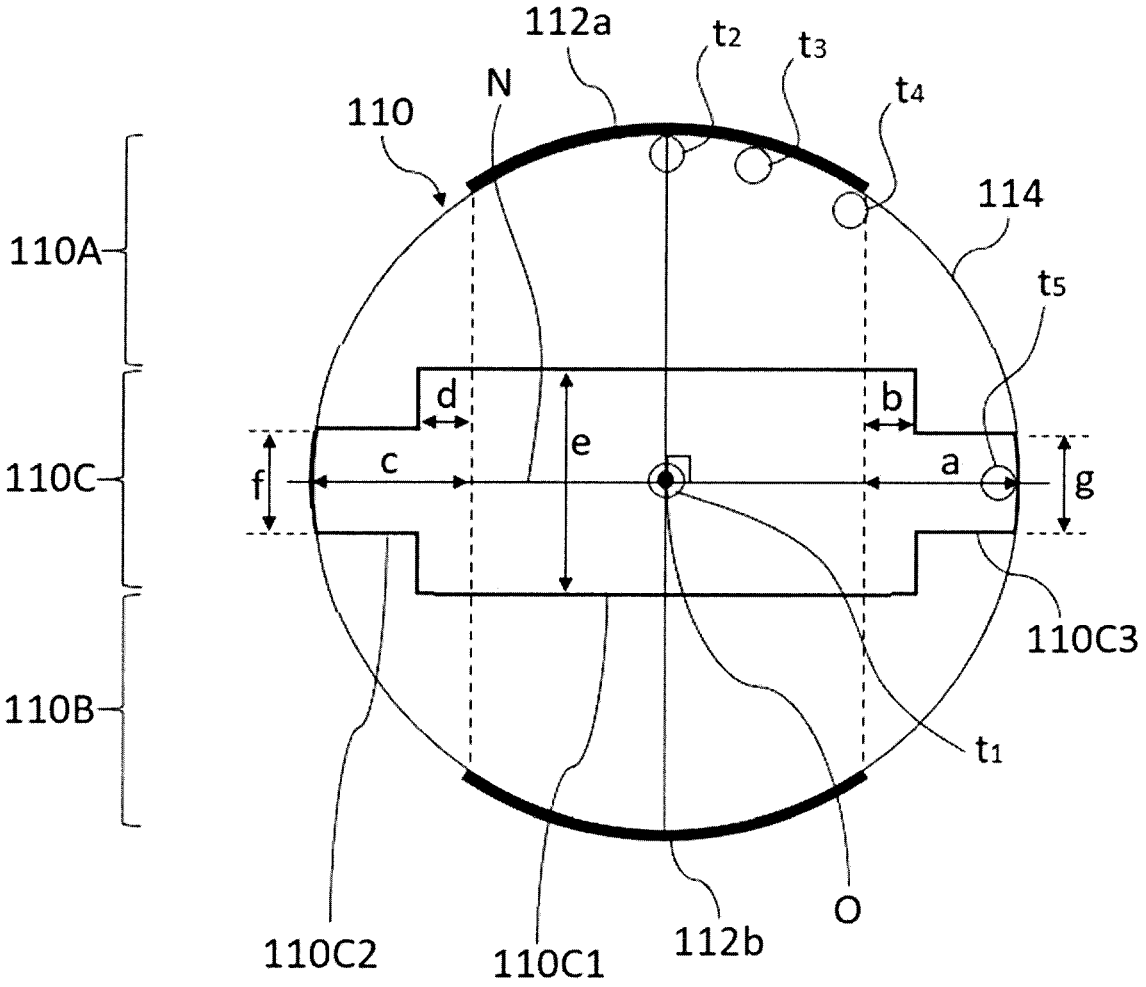
FIG. 5 is a schematic diagram showing an example of arrangement of each resistance region in a cross-section orthogonal to the direction in which the cells extend of the electric heating type carrier according to yet another embodiment of the present invention.

In the third resistance region 110C, as another method of increasing the amount of current in the outer peripheral portion, a method of narrowing the width in the vertical direction in the area of the third resistance region 110C corresponding to the outer peripheral portion of the honeycomb structure portion 110 can be mentioned. FIG. 5 is a schematic diagram showing an example of the arrangement of each resistance region (110A, 110B, 110C) in the cross-section orthogonal to the direction in which the cells extend according to the electric heating type carrier of the present invention in yet another embodiment.

In the embodiment shown in FIG. 5, when the cross-section orthogonal to the direction in which the cells extend is observed such that the first electrode layer 112*a* is located on the upper side and the second electrode layer 112*b* is located on the lower side, the third resistance region 110C is classified into three regions of:

- a central portion 110C1 comprising the central axis O of the honeycomb structure portion 110,
- a left side portion 110C2 adjacent to a left end of the central portion 110C1 and extending to a left end of the third resistance region 110C and having a width which is narrower in a vertical direction than the central portion 110C1, and
- a right side portion 110C3 adjacent to a right end of the central portion 110C1 and extending to a right end of the third resistance region 110C and having a width which is narrower in the vertical direction than the central portion 110C1.

In any of the embodiments shown in FIGS. 4 and 5, the length of the central portion 110C1 of the third resistance region 110C in the left-right direction may be appropriately set in consideration of the distribution of the amount of heat generation. However, in the third resistance region 110C, the current tends to flow inside the width in the left-right direction of the first electrode layer 112*a* and the second electrode layer 112*b*, and the amount of heat generation outside the width tends to be small. For this reason, it is preferable that the amount of current is increased outside the width in the left-right direction of the first electrode layer 112*a* and the second electrode layer 112*b*. Therefore, in a preferred embodiment, the right end of the central portion 110C1 of the third resistance region 110C is on a more right side than the right end of the first electrode layer 112*a* in the outer peripheral direction and is on a more right side than the right end of the second electrode layer 112*b* in the outer peripheral direction. Further, the left end of the central portion 110C1 of the third resistance region 110C is on a more left side than the left end of the first electrode layer 112*a* in the outer peripheral direction and is on a more left side than the left end of the second electrode layer 112*b* in the outer peripheral direction.

With respect to the embodiment shown in FIG. 4, in the cross-section orthogonal to the direction in which the cells extend, it is assumed that a straight line N passing through the central axis O and perpendicular to a straight line connecting the center of the first electrode layer 112*a* in the outer peripheral direction and the center of the second electrode layer 112*b* in the outer peripheral direction is drawn. On the straight line N, the length of the third resistance region 110C located on the more right side than the right end of the first electrode layer 112*a* (second electrode layer 112*b*) in the outer peripheral direction is designated as a, of which the length occupied by the central portion 110C1 of the third resistance region 110C is designated as b. Under this assumption, for example, $0.05 \leq b/a \leq 0.95$ can be satisfied, and typically $0.1 \leq b/a \leq 0.9$ can be satisfied.

Similarly, on the straight line N, it is assumed that the length of the third resistance region 110C located on the more left side than the left end of the first electrode layer 112*a* (second electrode layer 112*b*) in the outer peripheral direction is designated as c, of which the length occupied by the central portion 110C1 of the third resistance region 110C is designated as d. Under this assumption, for example, $0.05 \leq d/c \leq 0.95$ can be satisfied, and typically $0.1 \leq d/c \leq 0.9$ can be satisfied.

With respect to the embodiment shown in FIG. 5, in the cross-section orthogonal to the direction in which the cells extend, it is assumed that a straight line N passing through the central axis O and perpendicular to a straight line connecting the center of the first electrode layer 112*a* in the outer peripheral direction and the center of the second electrode layer 112*b* in the outer peripheral direction is drawn. On the straight line N, the length of the third resistance region 110C located on the more right side than the right end of the first electrode layer 112*a* (second electrode layer 112*b*) in the outer peripheral direction is designated as a, of which the length occupied by the central portion 110C1 of the third resistance region 110C is designated as b. Under this assumption, for example, $0.05 \leq b/a \leq 0.95$ can be satisfied, and typically $0.1 \leq b/a \leq 0.9$ can be satisfied.

Similarly, on the straight line N, it is assumed that the length of the third resistance region 110C located on the more left side than the left end of the first electrode layer 112*a* (second electrode layer 112*b*) in the outer peripheral direction is designated as c, of which the length occupied by the central portion 110C1 of the third resistance region 110C is designated as d. Under this assumption, for example, $0.05 \leq d/c \leq 0.95$ can be satisfied, and typically $0.1 \leq d/c \leq 0.9$ can be satisfied.

Furthermore, with respect to the embodiment shown in FIG. 5, in the cross-section orthogonal to the direction in which the cells extend, it is assumed that the vertical width of the central portion 110C1 of the third resistance region 110C is e, the vertical width of the left side portion 110C2 of the third resistance region 110C is f, and the vertical width of the right side portion 110C3 of the third resistance region 110C is g. Under this assumption, for example, $0.05 \leq f/e \leq 0.95$ and $0.05 \leq g/e \leq 0.95$ can be satisfied, and typically $0.1 \leq f/e \leq 0.9$ and $0.1 \leq g/e \leq 0.9$ can be satisfied.

It is assumed that the average value of the electrical resistance per unit volume (1 $cm^3$) of the first resistance region 110A is $R1_{ave}$, the average value of the electrical resistance per unit volume (1 $cm^3$) of the second resistance region 110B is $R2_{ave}$, and the average value of the electrical resistance per unit volume (1 $cm^3$) of the third resistance region 110C is $R3_{ave}$. The larger $R3_{ave}/R1_{ave}$ and $R3_{ave}/R2_{ave}$ are, the more advantageous it is to suppress the temperature rise in the vicinity of the first electrode layer 112*a* and the second electrode layer 112*b*, which tend to generate excessive heat. However, if they are made excessively large, on the contrary, the temperature near the central axis of the honeycomb structure portion becomes relatively high, which causes cracks to occur.

Therefore, in a preferred embodiment, it is desirable that either or both of (1) and (2) be satisfied, and it is more desirable that both (1) and (2) be satisfied.

$$1.2 \leq (R3_{ave}/R2_{ave}) \leq 4 \quad (1)$$

$$1.2 \leq (R3_{ave}/R2_{ave}) \leq 4 \quad (2)$$

In a more preferred embodiment, it is desirable that either or both of (3) and (4) be satisfied, and it is more desirable that both (3) and (4) be satisfied.

$$1.5 \leq (R3_{ave}/R1_{ave}) \leq 3.5 \quad (3)$$

$$1.5 \leq (R3_{ave}/R2_{ave}) \leq 3.5 \quad (4)$$

In an even more preferred embodiment, it is desirable that either or both of (5) and (6) be satisfied, and it is more desirable that both (5) and (6) be satisfied.

$$2 \leq (R3_{ave}/R1_{ave}) \leq 3 \quad (5)$$

$$2 \leq (R3_{ave}/R2_{ave}) \leq 3 \quad (6)$$

For the average value of electrical resistance per unit volume (1 $cm^3$) of each resistance region, it is possible to measure all the electrical resistances per unit volume (1 $cm^3$) of the plurality of square sections of the honeycomb structure portion constituting each resistance region and calculate the arithmetic mean as the average value.

$R1_{ave}$, $R2_{ave}$ and $R3_{ave}$ may be appropriately set according to the applied voltage, and there is no particular limitation. For example, $R3_{ave}$ can be 0.0001 to 20Ω. For a high voltage of 64V and above, it can be 0.1 to 20Ω, and typically 0.5 to 15Ω. Further, for a low voltage of less than 64V, it can be 0.0001 to 1Ω, and typically 0.001 to 0.5Ω.

The third resistance region 110C has no portion in contact with either the first electrode layer 112*a* or the second electrode layer 112*b*. From the viewpoint of enhancing heat generation uniformity, it is desirable that the third resistance region 110C is positioned away from the first electrode layer 112*a* and the second electrode layer 112*b*.

Specifically, referring to FIG. 3, in the cross-section orthogonal to the direction in which the cells extend, defining L as a crossing length of a straight line that crosses the honeycomb structure portion 110 when the center of the first electrode layer 112*a* in the outer peripheral direction and the center of the second electrode layer 112*b* in the outer peripheral direction are connected by this straight line (the distance between the surfaces of the outer peripheral wall, not including the electrode layers), it is preferable that the shortest distance D1 between the third resistance region 110C and the first electrode layer 112*a* be 0.02×L or more, and the shortest distance D2 between the third resistance region 1100 and the second electrode layer 112*b* be 0.02×L or more. It is more preferable that the shortest distance D1 be 0.03×L or more and the shortest distance D2 be 0.03×L or more. It is even more preferable that the shortest distance D1 be 0.05×L or more and the shortest distance D2 be 0.05×L or more.

The shortest distance D1 and the shortest distance D2 may be long as much as possible provided that the third resistance region 110C can exist. However, from the viewpoint of heat generation uniformity, it is more preferable that the shortest distance D1 be less than 0.5×L and the shortest distance D2 be less than 0.5×L. It is even more preferable that the shortest distance D1 be 0.45×L or less and the shortest distance D2 be 0.45×L or less. it is more particularly preferable that the shortest distance D1 be 0.3×L or less, and the shortest distance D2 be 0.3×L or less.

Therefore, in a preferred embodiment, $0.02\times L\leq D1<0.5\times L$ and $0.02\times L\leq D2<0.5\times L$ are satisfied, and in a more preferable embodiment, $0.03.\times L\leq D1\leq 0.3\times L$ and $0.03\times L\leq D2\leq 0.3\times L$ are satisfied, and in an even more preferable embodiment, $0.05\times L\leq D1\leq 0.3\times L$ and $0.05\times L\leq D2\leq 0.3\times L$ are satisfied.

Referring again to FIG. 3, in a preferred embodiment, in the cross-section orthogonal to the direction in which the cells extend, the first resistance region 110A, the second resistance region 110B, and the third resistance region 110C are formed line-symmetrically with the straight line N as the center of symmetry passing through the central axis O and perpendicular to a straight line connecting the center of the first electrode layer 112*a* in the outer peripheral direction and the center of the second electrode layer 112*b* in the outer peripheral direction. In addition, in a preferred embodiment, in the cross-section orthogonal to the direction in which the cells extend, the first electrode layer 112*a* and the second electrode layer 112*b* are formed line-symmetrically with the straight line as the center of symmetry N passing through the central axis O and perpendicular to a straight line connecting the center of the first electrode layer 112*a* in the outer peripheral direction and the center of the second electrode layer 112*b* in the outer peripheral direction. By forming the three resistance regions and the pair of electrode layers line-symmetrically with the line segment N as the center of symmetry, an electric heating type carrier having the same heat generation performance can be obtained regardless of which of the first electrode layer 112*a* and the second electrode layer 112*b* is used as a positive electrode (or which is used as a negative electrode). In the present specification, the central axis O refers to the position of the center of gravity of the honeycomb structure portion in the cross-section orthogonal to the direction in which the cells extend.

Figure 6:
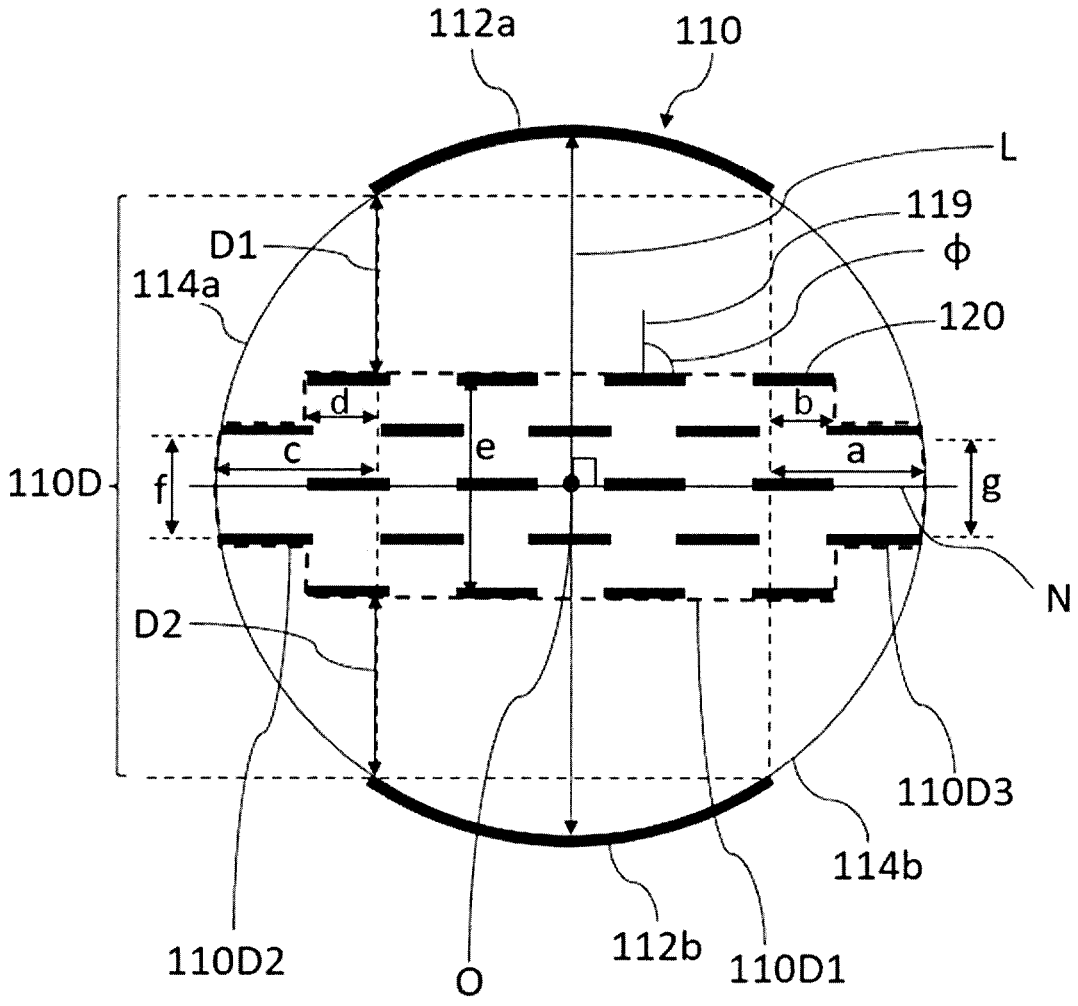
FIG. 6 is a schematic diagram showing an example of arrangement of a plurality of slits in a cross-section orthogonal to the direction in which the cells extend of the electric heating type carrier according to yet another embodiment of the present invention.

As described above, the slit(s) may be provided to increase the electric resistance in the third resistance region. However, it also can be provided even when the honeycomb structure portion does not have a distinction between a first resistance region, a second resistance region, and a third resistance region. FIG. 6 shows a schematic diagram showing an example of the arrangement of a plurality of slits in a cross-section orthogonal to the direction in which the cells extend for the electric heating type carrier according to yet another embodiment of the present invention.

Referring to FIG. 6, in the electric heating type carrier according to the embodiment, one or more slits 120 extending in a direction intersecting an imaginary line 119 parallel to a straight line connecting the center of the first electrode layer 112*a* in the outer peripheral direction and the center of the second electrode layer 112*b* in the outer peripheral direction are provided by lacking a part of the partition walls 113 in the region 110D sandwiched by the pair of opposing outer peripheral wall portions 114*a* and 114*b* on a surface of which neither the first electrode layer 112*a* nor the second electrode layer 112*b* is provided. In preferred embodiments, the one or more slits 120 have an angle $\varphi$ formed with the imaginary line 119 is in the range of 80° or more and 90° or less (provided that $0°\leq\varphi\leq 90°$).

Since the energization path is reduced by the presence of the slits 120, the electric resistance becomes high in the region where the slits 120 are provided (slit-forming region). Accordingly, by forming slits 120 in the region 110D sandwiched by the pair of opposing outer peripheral wall portions 114*a* and 114*b* the surface of which neither the first electrode layer 112*a* nor the second electrode layer 112*b* is provided, an effect similar to the case where the third resistance region 110C described above is provided can be expected. The slits 120 may be provided by lacking only the partition walls 113, but the slits 120 may be provided by lacking not only the partition walls 113 but also the outer peripheral wall 114.

The slit-forming region preferably has the same range as the range in which a third resistance region 110C extends. For example, as in the third resistance region 110C in the embodiment shown in FIG. 3, a plurality of slits 120 can be provided in a region that traverses a cross-section orthogonal to the direction in which the cells extend to the left and right, and has a constant width in the vertical direction.

Further, as the third resistance region 110C shown in FIG. 5, a plurality of slits 120 can be provided in a slit-forming region defined by a central portion including the central axis O, a left side portion located adjacent to the left side of the central portion and is narrower in the vertical direction than the central portion, and a right side portion located adjacent to the right side of the central portion and is narrower in the vertical direction than the central portion. In the embodiment shown in FIG. 6, the width of the slit-forming region in the vertical direction is narrower in the left side portion 110D2 and the right side portion 110D3 than in the central portion 110D1.

From the viewpoint of enhancing heat generation uniformity, it is desirable that the slits 120 be away from the first electrode layer 112*a* and the second electrode layer 112*b*.

Specifically, referring to FIG. 6, in the cross-section orthogonal to the direction in which the cells extend, defining L as a crossing length of a straight line that crosses the honeycomb structure portion 110 when the center of the first electrode layer 112*a* in the outer peripheral direction and the center of the second electrode layer 112*b* in the outer peripheral direction are connected by this straight line (the distance between the surfaces of the outer peripheral wall, not including the electrode layers), it is preferable that the shortest distance D1 of the slits 120 from the first electrode layer 112*a* be $0.02\times L$ or more, and the shortest distance D2 from the second electrode layer 112*b* be $0.02\times L$ or more. It is more preferable that the shortest distance D1 be $0.03\times L$ or more and the shortest distance D2 be $0.03\times L$ or more. It is even more preferable that the shortest distance D1 be $0.05\times L$ or more and the shortest distance D2 be $0.05\times L$ or more.

The shortest distance D1 and the shortest distance D2 may be long as much as possible provided that the slits 120 can exist. However, from the viewpoint of uniform heat generation, it is more preferable that the shortest distance D1 be less than $0.5\times L$ and the shortest distance D2 be less than $0.5\times L$. It is even more preferable that the shortest distance D1 be $0.45\times L$ or less and the shortest distance D2 be $0.45\times L$ or less, and particularly preferable that the shortest distance D1 be $0.3\times L$ or less, and the shortest distance D2 be $0.3\times L$ or less.

Therefore, in a preferred embodiment, $0.02\times L\leq D1\leq 0.5\times L$ and $0.02\times L\leq D2\leq 0.5\times L$ are satisfied, and in a more preferable embodiment, $0.03\times L\leq D1\leq 0.3\times L$ and $0.03\times L\leq D2$: $0.3\times L$ are satisfied, and in a more preferable embodiment, $0.05\times L\leq D1\leq 0.3\times L$ and $0.05\times L\leq D2\leq 0.3\times L$ are satisfied.

Furthermore, in a preferred embodiment, in the cross-section orthogonal to the direction in which the cells extend, the plurality of slits 120 is formed line-symmetrically with the straight line N as the center of symmetry passing through the central axis O and perpendicular to a straight line connecting the center of the first electrode layer 112*a* in the outer peripheral direction and the center of the second electrode layer 112*b* in the outer peripheral direction. In addition, in a preferred embodiment, in the cross-section orthogonal to the direction in which the cells extend, the first electrode layer 112*a* and the second electrode layer 112*b* are formed line-symmetrically with the straight line N as the center of symmetry passing through the central axis O and perpendicular to a straight line connecting the center of the first electrode layer 112*a* in the outer peripheral direction and the center of the second electrode layer 112*b* in the outer peripheral direction. By forming the plurality of slits 120 and the pair of electrode layers line-symmetrically with the line segment N as the center of symmetry, an electric heating type carrier having the same heat generation performance can be obtained regardless of which of the first electrode layer 112*a* and the second electrode layer 112*b* is used as a positive electrode (or which is used as a negative electrode).

In the embodiment shown in FIG. 6, when the cross-section orthogonal to the direction in which the cells extend is observed such that the first electrode layer 112*a* is located on the upper side and the second electrode layer 112*b* is located on the lower side, the length of the central portion 110D1 of the slit-forming region in the left-right direction may be appropriately set in consideration of the distribution of the amount of heat generation. However, in the slit-forming region, the current tends to flow on the inner side of the width in the left-right direction of the first electrode layer 112*a* and the second electrode layer 112*b*, and the amount of heat generation on the outer side of the width tends to be small. For this reason, it is preferable to promote the increase in the amount of current on the outer side of the width in the left-right direction of the first electrode layer 112*a* and the second electrode layer 112*b*. Therefore, in a preferred embodiment, the right end of the central portion 110D1 of the slit-forming region is on the more right side than the right end the first electrode layer 112*a* in the outer peripheral direction, and on the more right side than the right end of the second electrode layer 112*b* in the outer peripheral direction. Further, the left end of the central portion 110D1 of the slit-forming region is on the more left side than the left end of the first electrode layer 112*a* in the outer peripheral direction, and on the more left side than the left end of the second electrode layer 112*b* in the outer peripheral direction.

With respect to the embodiment shown in FIG. 6, in the cross-section orthogonal to the direction in which the cells extend, it is assumed that a straight line N passing through the central axis O and perpendicular to a straight line connecting the center of the first electrode layer 112*a* in the outer peripheral direction and the center of the second electrode layer 112*b* in the outer peripheral direction is drawn. In the direction in which the straight line N extends, it is assumed that the length of the slit-forming region on the more right side than the right end of the first electrode layer 112*a* (second electrode layer 112*b*) in the outer peripheral direction is a, and of which the length occupied by the central portion 110D1 is b. Under this assumption, for example, $0.05 \leq b/a \leq 0.95$ can be satisfied, and typically $0.1 \leq b/a \leq 0.9$ can be satisfied.

Similarly, in the direction in which the straight line N extends, it is assumed that the length of the slit-forming region on the more left side than the left end of the first electrode layer 112*a* (second electrode layer 112*b*) in the outer peripheral direction is c, and of which the length occupied by the central portion 110D1 is d. Under this assumption, for example, $0.05 \leq d/c \leq 0.95$ can be satisfied, and typically $0.1 \leq d/c \leq 0.9$ can be satisfied.

Furthermore, with respect to the embodiment shown in FIG. 6, in the cross-section orthogonal to the direction in which the cells extend, it is assumed that the vertical width of the central portion 110D1 of the slit-forming region is e, the vertical width of the left side portion 110D2 is f, and the vertical width of the right side portion 110D3 is g. Under this assumption, for example, $0.05 \leq f/e \leq 0.95$ and $0.05 \leq g/e \leq 0.95$ can be satisfied, and typically $0.1 \leq f/e \leq 0.9$ and $0.1 \leq g/e \leq 0.9$ can be satisfied.

The lower limit of the length of each slit 120 in the longitudinal direction (left-right direction in FIG. 6) is not particularly limited, but is generally 2 mm or more. As to the upper limit of the length of each slit 120 in the longitudinal direction, from the reason of strength (if there is a lot of lacked cells, the strength decreases and it cannot withstand the stress during canning), it is preferably 0.5×L or less, more preferably 0.25×L or less, and even more preferably 0.125×L or less.

The lower limit of the length of each slit 120 in the lateral direction (vertical direction in FIG. 6) is not particularly limited, but is generally 1 mm or more. As to the upper limit of the length of each slit 120 in the lateral direction, from the reason of strength (if there is a lot of lacked cells, the strength decreases and it cannot withstand the stress during canning), it is preferably 0.07×L or less, more preferably 0.05×L or less, and even more preferably 0.015×L or less.

The arrangement of the plurality of slits 120 is not limited, but it is preferable to arrange the plurality of slits 120 evenly in the slit-forming region. Specifically, in the cross-section orthogonal to the direction in which the cells extend, it is preferable that the plurality of slits 120 form a row of slits 120 arranged at equal intervals in a direction (left-right direction in FIG. 6) perpendicular to the straight line connecting the center of the first electrode layer 112*a* in the outer peripheral direction and the center of the second electrode layer 112*b* in the outer peripheral direction. One row of slits 120 can be composed of, for example, 1 to 27 slits. Further, it is preferable that a plurality of rows of slits 120 be provided at equal intervals in the vertical direction. The number of rows of slits 120 provided in the vertical direction can be, for example, 1 to 50. In the embodiment shown in FIG. 6, five rows of slits 120 arranged at equal intervals in the left-right direction are provided at equal intervals in the vertical direction.

When arranging rows of a plurality of slits 120 in the vertical direction, it is preferable to arrange the slits 120 in a staggered pattern. As a result, when a voltage is applied between the first electrode layer 112*a* and the second electrode layer 112*b*, the energization path is evenly reduced in the slit-forming region, so that the heat generation uniformity is improved. Furthermore, when arranging rows of a plurality of slits 120 in the vertical direction, it is preferable to arrange the plurality of slits such that there is no energization path that passes through the slit-forming region linearly in the extending direction of the straight line connecting the center of the first electrode layer 112*a* in the outer peripheral direction and the center of the second electrode layer 112*b* in the outer peripheral direction (vertical direction in FIG. 6).

The materials of the outer peripheral wall 114 and the partition walls 113 are not particularly limited as long as they can be energized and generate heat by Joule heat, and ceramics (particularly conductive ceramics) can be used alone or in combination. The material of the outer peripheral wall 114 and the partition walls 113 is not limited, but one or more kinds of oxide-based ceramics such as alumina, mullite, zirconia and cordierite, and non-oxide ceramics such as silicon carbide, silicon nitride and aluminum nitride can be used. Further, a silicon carbide-metallic silicon composite material, a silicon carbide/graphite composite material, or the like can also be used. Among these, from the viewpoint of achieving both heat resistance and conductivity, the material of the outer peripheral wall 114 and the partition walls 113 preferably contains a silicon-silicon carbide composite material or silicon carbide as a main component, and more preferably is a silicon-silicon carbide composite material or silicon carbide. When the material of the outer peripheral wall 114 and the partition walls 113 contains a silicon-silicon carbide composite material as a main component, it means that the outer peripheral wall 114 and the partition walls 113 contain silicon-silicon carbide composite material (total mass) in an amount of 90% by mass or more of the whole, respectively. Here, the silicon-silicon carbide composite material contains silicon carbide particles as an aggregate and silicon as a bonding material for bonding silicon carbide particles, and it is preferable that a plurality of silicon carbide particles be bonded by the silicon to form pores among the silicon carbide particles. When the material of the outer peripheral wall 114 and the partition walls 113 contains a silicon carbide as a main component, it means that the outer peripheral wall 114 and the partition walls 113 contain silicon carbide (total mass) in an amount of 90% by mass or more of the whole, respectively.

When the outer peripheral wall 114 and the partition walls 113 contain a silicon-silicon carbide composite material, a ratio of "mass of silicon as a bonding material" contained in the outer peripheral wall 114 and the partition walls 113 to the total of the "mass of silicon carbide particles as an aggregate" contained in the outer peripheral wall 114 and the partition walls 113 and the "mass of silicon as a bonding material" contained in the outer peripheral wall 114 and the partition walls 113 is preferably 10 to 40% by mass, more preferably 15 to 35% by mass, respectively. When it is 10% by mass or more, the strength of the outer peripheral wall 114 and the partition walls 113 is sufficiently maintained. When it is 40% by mass or less, it becomes easy to maintain the shape at the time of firing.

The shape of the cell in the cross-section perpendicular to the direction in which the cells 115 extend is not limited, but is preferably a quadrangle, a hexagon, an octagon, or a combination thereof. Among these, a quadrangle and a hexagon are preferable. By making the cell shape in this way, the pressure loss when exhaust gas is passed through the honeycomb structure portion 110 is reduced, and the purification performance of the catalyst is improved.

The cells 115 may be opened through from one end surface 116 to the other end surface 118. Further, the cells 115 may be configured such that firsts cells each sealed on one end surface 116 and having an opening on other end surface 118, and second cells each having an opening on one end surface 116 and sealed on the other end surface 118 are arranged adjacent to each other with the partition walls 113 interposed therebetween.

The thickness of the partition walls 113 forming the cells 115 is preferably 0.1 to 0.3 mm, more preferably 0.1 to 0.2 mm. When the thickness of the partition wall 113 is 0.1 mm or more, it is possible to suppress the decrease in the strength of the honeycomb structure portion 110. When the thickness of the partition wall 113 is 0.3 mm or less, and the honeycomb structure portion 110 is used as a catalyst carrier and a catalyst is carried, it is possible to suppress an increase in pressure loss when exhaust gas is flowed. In the present invention, the thickness of the partition wall 113 refers to a crossing length of a line segment that crosses the partition wall 113 when the centers of gravity of adjacent cells 115 are connected by this line segment in the cross-section perpendicular to the direction in which the cells 115 extend.

In the cross-section orthogonal to the direction in which the cells 115 extend, the honeycomb structure 110 preferably has a cell density of 40 to 150 cells/cm$^2$, and more preferably 70 to 100 cells/cm$^2$. By setting the cell density in such a range, the purification performance of catalyst can be improved while the pressure loss when exhaust gas is passed through the honeycomb structure portion 110 is reduced. When the cell density is 40 cells/cm$^2$ or more, a sufficient area for carrying catalyst is secured. When the cell density is 150 cells/cm$^2$ or less, when the honeycomb structure portion 110 is used as a catalyst carrier and a catalyst is carried, it is possible to prevent the pressure loss from becoming too large when exhaust gas is flown. The cell density is a value obtained by dividing the number of cells by the area of one end surface of the honeycomb structure portion 110 on the inner peripheral side of the outer peripheral wall 114.

The partition walls 113 may be dense as in the form of Si-impregnated SiC, but is preferably porous. The porosity of the partition walls 113 is preferably 35 to 60%, more preferably 35 to 45%. When the porosity is 35% or more, it becomes easier to suppress deformation during firing. When the porosity is 60% or less, the strength of the honeycomb structure portion 110 is sufficiently maintained. The porosity is a value measured by a mercury porosimeter. In addition, "dense" means that the porosity is 5% or less.

The average pore diameter of the partition walls 113 is preferably 2 to 15 μm, more preferably 4 to 8 μm. When the average pore diameter is 2 μm or more, the volume resistivity is prevented from becoming too large. When the average pore diameter is 15 μm or less, the volume resistivity is prevented from becoming too small. The average pore diameter is a value measured by a mercury porosimeter.

(1-2. Electrode Layer)

The electrode layers (112*a*, 112*b*) will be described with reference to FIGS. 1A and 1B. On the surface of the outer peripheral wall 114, a first electrode layer 112*a* is provided in a band shape in the direction in which the cells 115 extend. Further, on the surface of the outer peripheral wall 114, a second electrode layer 112*b* is provided in a band shape in the direction in which the cells 115 extend so as to oppose the first electrode layer 112*a* with the central axis O of the honeycomb structure portion 110 interposed therebetween. Generally, the first electrode layer 112*a* and the second electrode layer 112*b* have a lower volume resistivity than the outer peripheral wall 114. Therefore, by providing the pair of electrode layers 112*a* and 112*b* on the surface of the outer peripheral wall 114, the current tends to spread in the peripheral direction of the honeycomb structure portion 110 and in the direction in which the cells 115 extend, so that the heat generation uniformity of the honeycomb structure portion 110 can be improved. Specifically, in the cross-section perpendicular to the direction in which the cells 115 extend, the angle θ (0°≤θ≤180°) formed by two line segments extending from the center in the peripheral direction of each of the pair of electrode layers 112*a* and 112*b* to the central axis O of the honeycomb structure portion 110 is preferably 150°≤θ≤180°, more preferably 160°≤θ≤180°, even more preferably 170°≤θ≤180°, and most preferably 180°.

There are no particular restrictions on the areas to form the electrode layers 112*a* and 112*b*, but from the viewpoint of enhancing the heat generation uniformity of the honeycomb structure portion 110, it is preferable that the electrode layers 112*a* and 112*b* extend in a band shape on the outer surface of the outer peripheral wall 114 in the peripheral direction of the honeycomb structure portion 110 and in the direction in which the cells 115 extend, respectively. Specifically, in the cross-section perpendicular to the direction in which the cells 115 extend, the central angle α formed by two line segments connecting both ends of each of the electrode layers 112*a* and 112*b* in the peripheral direction and the central axis O is preferably 30° or more, more preferably 40° or more, and even more preferably 60° or more, from the viewpoint of spreading the current in the peripheral direction to enhance heat generation uniformity. However, if the central angle α is made too large, the current passing through the inside of the honeycomb structure portion 110 decreases, and the current passing near the outer peripheral wall 114 increases. Therefore, the central angle α is preferably 140° or less, more preferably 130° or less, and even more preferably 120° or less, from the viewpoint of the heat generation uniformity of the honeycomb structure portion 110. Further, it is desirable that the electrode layers 112*a* and 112*b* each extend over a length of 80% or more, preferably a length of 90% or more, and more preferably a total length of the length between both end surfaces of the honeycomb structure portion 110. Each of the electrode layers 112*a* and 112*b* may be formed with a single layer or have a laminate structure in which a plurality of layers is laminated.

The thickness of the electrode layers 112*a* and 112*b* is preferably 0.01 to 5 mm, more preferably 0.01 to 3 mm. By setting it in such a range, heat generation uniformity can be enhanced. When the thickness of the electrode layers 112*a* and 112*b* is 0.01 mm or more, the electric resistance is appropriately controlled and heat can be generated more uniformly. When it is 5 mm or less, the risk of breakage during canning is reduced. The thickness of the electrode layers 112*a* and 112*b* is defined as the thickness in the normal direction with respect to a tangential line of the outer surface of the electrode layers 112*a* and 112*b* at the measurement point when observing the location of the electrode layers 112*a* and 112*b* for which the thickness is to be measured in a cross-section perpendicular to the direction in which the cells 115 extend.

By making the volume resistivity of the electrode layers 112*a* and 112*b* lower than the volume resistivity of the partition wall 113 and the outer peripheral wall 114, the current tends to flow preferentially to the electrode layers 112*a* and 112*b*, and the current tends to spread in the peripheral direction of the honeycomb structure portion 110 and in the direction in which the cells 115 extend when energized. The volume resistivity of the electrode layers 112*a* and 112*b* is preferably 1/10 or less, more preferably 1/20 or less, and even more preferably 1/30 or less of the volume resistivity of the partition walls 113 and the outer peripheral wall 114. However, if the difference in volume resistivity between the two becomes too large, the current is concentrated between the ends of the opposing electrode layers 112*a* and 112*b*, and the heat generation of the honeycomb structure portion 110 is biased. Therefore, the volume resistivity of the electrode layers 112*a* and 112*b* is preferably 1/200 or more, more preferably 1/150 or more, and even more preferably 1/100 or more of the volume resistivity of the partition walls 113 and the outer peripheral wall 114. In the present invention, the volume resistivity of the electrode layer, the partition walls and the outer peripheral wall is a value measured at 25° C. by a four-terminal method.

The material of the electrode layers 112*a* and 112*b* is not limited, but a composite material (cermet) of a metal and ceramics (particularly conductive ceramics) can be used. As the metals, mention can be made to, for example, elemental metals of Cr, Fe, Co, Ni, Si or Ti, or an alloy containing at least one metal selected from these metals. As the ceramics, mention can be made to, but not limited to, silicon carbide (SiC), as well as metal compounds such as metal silicides such as tantalum silicate ($TaSi_2$) and chromium silicate ($CrSi_2$). As specific examples of a composite material (cermet) of metal and ceramics, mention can be made to a composite material of metallic silicon and silicon carbide, a composite material of metallic silicide such as tantalum silicate and chromium silicate, metallic silicon, and silicon carbide, and furthermore, from the viewpoint of reducing thermal expansion, a composite material of the above one or more kinds of metals to which one or more kinds of insulating ceramics such as alumina, mullite, zirconia, cordierite, silicon nitride and aluminum nitride are added. As the material of the electrode layers 112*a* and 112*b*, among the various metals and ceramics described above, it is preferable to use a composite material of metallic silicon and silicon carbide because it can be fired at the same time as the partition walls and the outer peripheral wall, which contributes to simplification of the manufacturing process.

(1-3. Metal Terminal)

Referring to FIGS. 1A and 1B, the electric heating type carrier 100 may be provided with at least one first metal terminal 130*a* electrically connected to the first electrode layer 112*a* and at least one second metal terminal 130*b* electrically connected to the second electrode layer 112*b*. The first electrode layer 112*a* and the first metal terminal 130*a* may be directly bonded, or one or more underlying layers (not shown) may be provided between the first electrode layer 112*a* and the first metal terminal 130*a* for the purpose of mitigating the difference in thermal expansion and improving the bonding reliability. Similarly, the second electrode layer 112*b* and the second metal terminal 130*b* may be directly bonded, or one or more underlying layers may be provided between the second electrode layer 112*b* and the second metal terminal 130*b* for the purpose of mitigating the difference in thermal expansion and improving the bonding reliability.

When a voltage is applied to the honeycomb structure portion 110 via the metal terminals 130*a* and 130*b*, it is energized and Joule heat is generated in the honeycomb structure portion 110. Accordingly, the honeycomb structure portion 110 can also be suitably used as a heater. This makes it possible to improve the heating uniformity of the honeycomb structure portion 110. The applied voltage is preferably 12 to 900 V, more preferably 48 to 600 V, but the applied voltage can be changed as appropriate.

The method of joining the metal terminals 130*a* and 130*b* and the electrode layers 112*a* and 112*b* (the underlying layer when an underlying layer is provided) is not particularly limited, and examples thereof include welding, thermal spraying, and brazing. Among these, welding and thermal spraying are preferable because the change of properties of the joint portion is small even when heated to 800° C. or higher.

As the material of the metal terminals 130*a* and 130*b*, there are no particular restrictions as long as it is metal, and an elemental metal, an alloy, or the like can be adopted. However, from the viewpoint of corrosion resistance, volume resistivity, and linear expansion rate, for example, it is preferable to use an alloy containing at least one selected from the group consisting of Cr, Fe, Co, Ni and Ti, and stainless steel and Fe—Ni alloys are more preferable.

(2. Manufacturing Method)

Next, a method for manufacturing an electric heating type carrier according to an embodiment of the present invention will be explained as an example. The electric heating carrier can be manufactured by a manufacturing method comprising a step A1 for obtaining a honeycomb formed body, a step A2 for obtaining an unfired honeycomb structure with an electrode layer forming paste, a step A3 for firing the unfired honeycomb structure with the electrode layer forming paste to obtain a honeycomb structure, and a A4 of joining metal terminals to the electrode layers of the honeycomb structure.

(Step A1)

Step A1 is a step of forming a honeycomb formed body which is a precursor of the honeycomb structure. The honeycomb formed body can be prepared according to a method for preparing a honeycomb formed body in a known method for manufacturing a honeycomb structure. For example, first, a metallic silicon powder (metal silicon), a binder, a surfactant, a pore-forming material, water, or the like is added to a silicon carbide powder (silicon carbide) to prepare a raw material for forming. It is preferable that the mass of the metallic silicon powder be 10 to 40% by mass with respect to the total of the mass of the silicon carbide powder and the mass of the metallic silicon powder. The average particle diameter of the silicon carbide particles in the silicon carbide powder is preferably 3 to 50 μm, more preferably 3 to 40 μm. The average particle diameter of the metallic silicon particles in the metallic silicon powder is preferably 2 to 35 μm. The average particle diameter of the silicon carbide particles and the metallic silicon particles refers to the arithmetic average diameter on a volume base when a frequency distribution of the particle diameters is measured by a laser diffraction method. The silicon carbide particles are fine particles of silicon carbide constituting the silicon carbide powder, and the metallic silicon particles are fine particles of metallic silicon constituting the metallic silicon powder. Note that this is a composition of raw material for forming when the material of the honeycomb structure is silicon-silicon carbide-based composite material, and when the material of the honeycomb structure is silicon carbide, metallic silicon is not added.

As the binder, mention can be made to methyl cellulose, hydroxypropyl methyl cellulose, hydroxypropoxyl cellulose, hydroxyethyl cellulose, carboxymethyl cellulose, polyvinyl alcohol, and the like. Among these, it is preferable to use methyl cellulose and hydroxypropoxyl cellulose in combination. The binder content is preferably 2.0 to 10.0 parts by mass when the total mass of the silicon carbide powder and the metallic silicon powder is 100 parts by mass.

As the surfactant, ethylene glycol, dextrin, fatty acid soap, polyalcohol and the like can be used. One type of these may be used alone, or two or more types may be used in combination. The content of the surfactant is preferably 0.1 to 2.0 parts by mass when the total mass of the silicon carbide powder and the metallic silicon powder is 100 parts by mass.

The pore-forming material is not particularly limited as long as it becomes pores after firing, and examples thereof include graphite, starch, foamed resin, water-absorbent resin, silica gel, and the like. The content of the pore-forming material is preferably 0.5 to 10.0 parts by mass when the total mass of the silicon carbide powder and the metallic silicon powder is 100 parts by mass. The average particle diameter of the pore-forming material is preferably 10 to 30 μm. The average particle diameter of the pore-forming material refers to the arithmetic mean diameter on a volume base when a frequency distribution of the particle diameters is measured by a laser diffraction method. When the pore-forming material is a water-absorbent resin, the average particle diameter of the pore-forming material is the average particle diameter after water absorption.

The water content is preferably 20 to 60 parts by mass when the total mass of the silicon carbide powder and the metallic silicon powder is 100 parts by mass.

Next, the obtained raw material for forming is kneaded to form a green body, and then the green body is subjected to extrusion molding to prepare a honeycomb formed body having an outer peripheral wall and partition walls. In extrusion molding, a die having a desired overall shape, cell shape, partition wall thickness, cell density and the like can be used. When a slit configured by lacking a part of the partition walls 113 of the third resistance region 110C is provided, the partition walls can be lacked by closing a part of the die corresponding to the area where the partition walls are to be lacked. Next, it is preferable to dry the obtained honeycomb formed body. If the length in the central axis direction of the honeycomb formed body is not the desired length, both ends of the honeycomb formed body can be cut to obtain the desired length. The dried honeycomb formed body is called a honeycomb dried body.

As a variation of step A1, the honeycomb formed body may be fired once. That is, in this variation, the honeycomb formed body is fired to prepare a honeycomb fired body, and the step A2 is performed on the honeycomb fired body.

(Step A2)

Step A2 is a step of applying an electrode layer forming paste to the side surface of the honeycomb formed body to obtain an unfired honeycomb structure with the electrode layer forming paste. The electrode layer forming paste can be formed by appropriately adding various additives to a raw material powder (metal powder, ceramic powder, and the like) blended according to the required characteristics of the electrode layer, and then kneading. The average particle diameter of the raw material powder is not limited, but is preferably, for example, 5 to 50 μm, and more preferably 10 to 30 μm. The average particle diameter of the raw material powder refers to the arithmetic mean diameter on a volume base when a frequency distribution of the particle diameters is measured by a laser diffraction method.

Next, the obtained electrode layer forming paste is applied to a required portion on the side surface of the honeycomb formed body (typically, a honeycomb dried body) to obtain an unfired honeycomb structure with the electrode layer forming paste. The method of preparing the electrode layer forming paste and the method of applying the electrode layer forming paste to the honeycomb formed body can be performed according to a known method for manufacturing a honeycomb structure. However, in order to make the electrode layer have a lower volume resistivity than the outer peripheral wall and the partition walls, the metal content ratio can be increased as compared with the outer peripheral wall and the partition walls, and/or the particle diameter of the metal particles in the raw material powder can be reduced.

(Step A3)

Step A3 is a step of firing the unfired honeycomb structure with the electrode layer forming paste to obtain a honeycomb structure. Before firing, the unfired honeycomb structure with the electrode layer forming paste may be dried. Further, before firing, degreasing may be performed in order to remove the binder and the like. As the firing conditions, though it depends on the material of the honeycomb structure, it is preferable to heat it at 1400 to 1500° C. for 1 to 20 hours in an inert atmosphere such as nitrogen and argon. Further, after firing, it is preferable to carry out an oxidation treatment at 1200 to 1350° C. for 1 to 10 hours in order to improve durability. The method of degreasing and firing is not particularly limited, and firing can be performed using an electric furnace, a gas furnace, or the like.

(Step A4)

Step A4 is a step of joining metal terminals on the electrode layers of the honeycomb structure. Joining methods include welding, thermal spraying, brazing, and the like, and metal terminals are joined by these methods.

An appropriate catalyst may be carried on the honeycomb structure depending on the application. As a method of carrying a catalyst on the honeycomb structure, mention can be made to a method in which a catalyst slurry is introduced into the cells by a conventionally known suction method or the like, adhered to the surface of the partition walls or pores, and then subjected to a high temperature treatment such that the catalyst contained in the catalyst slurry is baked onto the partition walls to carry the catalyst.

(3. Exhaust Gas Purification Device)

The electric heating type carrier according to the embodiments of the present invention can be used for an exhaust gas purification device. The exhaust gas purification device comprises an electric heating type carrier, and a tubular metal tube accommodating the electric heating type carrier. In the exhaust gas purification device, the electric heating type carrier can be installed on the way of an exhaust gas flow path for flowing an exhaust gas from an engine. As the metal tube, a metal tubular member or the like for accommodating the electric heating type carrier can be used.

EXAMPLES

Hereinafter, Examples for better understanding the present invention and its advantages will be illustrated, but the present invention is not limited to the Examples.

I. TEST NO. 1-8

(1. Preparation of Cylindrical Green Body)

Silicon carbide (SiC) powder and metallic silicon (Si) powder were mixed at a mass ratio of 80:20 to prepare a ceramic raw material. Then, hydroxypropylmethylcellulose as a binder and a water-absorbent resin as a pore-forming material were added to the ceramic raw material, and water was added to obtain a raw material for forming. Then, the raw material for forming was kneaded with a vacuum clay kneader to prepare a cylindrical green body. The binder content was 7 parts by mass when the total of the silicon carbide (SiC) powder and the metallic silicon (Si) powder was 100 parts by mass. The content of the pore-forming material was 3 parts by mass when the total of the silicon carbide (SiC) powder and the metallic silicon (Si) powder was 100 parts by mass. The water content was 42 parts by mass when the total of the silicon carbide (SiC) powder and the metallic silicon (Si) powder was 100 parts by mass. The average particle diameter of the silicon carbide powder was 20 μm, and the average particle diameter of the metallic silicon powder was 6 μm. The average particle diameter of the pore-forming material was 20 μm. The average particle diameter of the silicon carbide powder, the metallic silicon powder, and the pore-forming material refers to the arithmetic mean diameter on a volume base when the frequency distribution of the particle diameters is measured by a laser diffraction method.

(2. Preparation of Honeycomb Dried Body)

The obtained cylindrical green body was formed using an extrusion molding machine having a grid-like die structure to obtain a cylindrical honeycomb formed body having a hexagonal cell shape in the cross-section perpendicular to the cell flow path direction. At the time of extrusion molding, the die was designed so that the thickness of all partition walls was constant in Test No. 1. On the other hand, for Test No. 2 to 8, when the cross-section orthogonal to the direction in which the cells extend is observed such that the first electrode layer 112*a* was located on the upper side and the second electrode layer 112*b* was located on the lower side, the thickness of the partition walls in the area where the third resistance region 110C was to be formed was made thinner than the thickness of the partition walls in the area where the first resistance region 110A and the second resistance region 110B were to be formed so as to form a band-shaped third resistance region 110C across the cross-section from right to left and having a constant width in the vertical direction. The level of thinness was varied according to the test number. This honeycomb formed body was dried by high frequency dielectric heating and then dried at 120° C. for 2 hours using a hot gas dryer, and both end surfaces were cut by a predetermined amount to prepare a honeycomb dried body.

(3. Preparation of Electrode Layer Forming Paste)

Metallic silicon (Si) powder, silicon carbide (SiC) powder, methyl cellulose, glycerin, and water were mixed with a planetary centrifugal mixer to prepare an electrode layer forming paste. The Si powder and the SiC powder were blended so that the volume ratio was Si powder:SiC powder=40:60. Further, the methyl cellulose was 0.5 parts by mass, the glycerin was 10 parts by mass, and the water was 38 parts by mass, when the total of the Si powder and the SiC powder was 100 parts by mass. The average particle diameter of the metallic silicon powder was 6 μm. The average particle diameter of the silicon carbide powder was 35 μm. These average particle diameters refer to the arithmetic mean diameter on a volume base when the frequency distribution of particle diameter was measured by a laser diffraction method.

(4. Application of Electrode Layer Forming Paste)

The above-mentioned electrode layer-forming paste was applied in two places on the outer surface of the outer peripheral wall of the above-mentioned honeycomb dried body by a curved surface printing machine so as to oppose each other with the central axis interposed therebetween. Each applied portion was formed in a band shape over the entire length between both end surfaces of the dried honeycomb body (angle $\theta$=180°, central angle $\alpha$=100°).

(5. Firing)

The honeycomb dried body with the electrode layer forming paste was dried at 120° C. and then degreased at 550° C. for 3 hours in the air atmosphere. Next, the honeycomb dried body with the degreased electrode layer forming paste was fired, and then oxidation treatment was carried out to prepare a honeycomb structure with electrode layers. The firing was carried out for 2 hours in an argon atmosphere at 1450° C. The oxidation treatment was carried out in the air atmosphere at 1300° C. for 1 hour. A required number of honeycomb structures with electrode layers of each test number was prepared for the following evaluation.

The honeycomb structure with electrode layers obtained under the above manufacturing conditions had circular end surfaces having a diameter of 93 mm (excluding the electrode layers) and a height (length in the direction in which the cells extend) of 65 mm. The cell density was 90 cells/cm$^2$, the thickness of the outer peripheral wall was 300 μm, the porosity of the partition walls was 45%, and the average pore diameter of the partition walls was 8.6 μm. The thickness of the electrode layer was 0.3 mm. Table 1 shows the thickness of the partition walls of each resistance region in each test number.

Further, regarding each of the arrangement of the resistance regions in the honeycomb structure portion of the honeycomb structures with electrode layers according the Test No. 2 to 8 obtained under the above manufacturing conditions, L=93 mm, D1=0.05×L (4.89 mm), and D2=0.05×L (4.89 mm). The definitions of L, D1 and D2 are as described above. Further, the first resistance region 110A, the second resistance region 110B, and the third resistance region 110C were formed line-symmetrically with the straight line N as the center of symmetry passing through the central axis O and perpendicular to the straight line L connecting the center of the first electrode layer 112*a* in the outer peripheral direction and the center of the second electrode layer 112*b* in the outer peripheral direction.

For Test No. 1, since the electrical resistance per unit volume (1 $cm^3$) in the honeycomb structure was substantially constant, a 3 $cm^3$ rectangular parallelepiped sample was taken from the honeycomb structure at an arbitrary location and measured at room temperature (25° C.) according to a four-terminal method. For Test No. 2 to 8, since the electrical resistance per unit volume (1 $cm^3$) in the first resistance region 110A, the second resistance region 110B, and the third resistance region 110C is substantially constant in each respective region, A rectangular parallelepiped sample of 3 $cm^3$ was taken from each resistance region of the honeycomb structure at an arbitrary location, and measured at room temperature (25° C.) according to a four-terminal method. The results are shown in Table 1. Note that the electric resistance values shown in Table 1 are equivalent to the average values of the electric resistance per unit volume (1 $cm^3$) in each resistance region.

(6. Simulation of Temperature Distribution)

Regarding the honeycomb structures obtained under the above manufacturing conditions, when a voltage of 7 kW was applied to the center of each surface of the pair of electrode layers for 30 s, the temperature distribution of the cross-section orthogonal to the direction in which the cells extend in the center of the honeycomb structure in the direction in which the cells extend was simulated using commercially available finite element method CAE analysis software. There were five temperature measurement points, $t_1$ to $t_5$, shown in FIG. 3. In addition, for the first resistance region 110A, the second resistance region 110B, and the third resistance region 110C are, since they were formed line-symmetrically with the straight line N as the center of symmetry, the temperature distribution of the lower half in FIG. 3 is not described, and it appeared almost line-symmetrically with the upper half. The results are shown in Table 2.

(7. Crack Evaluation)

Regarding the honeycomb structures obtained under the above manufacturing conditions, after the voltage of 7 kW was applied to the center of each surface of the pair of electrode layers for 30 s, cracks in the outer peripheral wall and the electrode layers were visually evaluated. The evaluation of cracks was based on the following criteria. The results are shown in Table 2.

A: No cracks

B: Fine cracks confirmed (cracks which cannot be confirmed from the energization distribution and do not affect the energization performance)

C: Cracks confirmed (cracks can be confirmed from the energization distribution, which affects the energization performance)

II. TEST NO. 9-12

Cylindrical honeycomb structures were obtained by the same procedure as in Test No. 3 except that the crossing length (L) of the straight line crossing the honeycomb structure portion 110 and connecting the center of the first electrode layer 112*a* in the outer peripheral direction and the center of the second electrode layer 112*b* in the outer peripheral direction, the electrode layer formation region (central angle α), and the arrangements (D1 and D2) of the first resistance region 110A, the second resistance region 110B and the third resistance region 110C were changed as shown in Table 2. For the obtained honeycomb structure, the temperature distribution simulation and crack evaluation were carried out by the same method as in Test No. 3. The results are shown in Table 2

III. TEST NO. 13

(1. Preparation of Cylindrical Green Body)

A cylindrical green body was prepared in the same procedure as in Test No. 1 except that the diameter was different.

(2. Preparation of Honeycomb Dried Body)

The obtained cylindrical green body was formed using an extrusion molding machine having a grid-like die structure to obtain a cylindrical honeycomb formed body having a hexagonal cell shape in the cross-section perpendicular to the cell flow path direction. At the time of extrusion molding, the thickness of the partition walls at the area where the third resistance region 110C was to be formed was made thinner than the thickness of the partition walls at the area where the first resistance region 110A and the second resistance region 110B were to be formed so that a band-shaped third resistance region 110C having a constant vertical width was formed from right to left across the cross-section orthogonal to the direction in which the cells extend, when the cross-section orthogonal to the direction in which the cells extend was observed such that the first electrode layer 112*a* was located on the upper side and the second electrode layer 112*b* was located on the lower side, as shown in FIG. 4. Further, the thickness of the partition walls in the third resistance region 110C was adjusted so that the following three regions were formed in the third resistance region 110C.

- a central portion 110C1 comprising the central axis O of the honeycomb structure portion 110,
- a left side portion 110C2 adjacent to the left end of the central portion 110C1 and extending to the left end of the third resistance region 110C and having a lower electrical resistance per unit volume (1 $cm^3$) than the central portion 110C1, and
- a right side portion 110C3 adjacent to the right end of the central portion 110C1 and extending to the right end of the third resistance region 110C and having a lower electrical resistance per unit volume (1 $cm^3$) than the central portion 110C1.

This honeycomb formed body was dried by high frequency dielectric heating and then dried at 120° C. for 2 hours using a hot gas dryer, and both end surfaces were cut by a predetermined amount to prepare a honeycomb dried body.

(3. Preparation of Electrode Layer Forming Paste)

The same electrode layer forming paste as in Test No. 1 was prepared.

(4. Application of Electrode Layer Forming Paste)

The above-mentioned electrode layer-forming paste was applied in two places on the outer surface of the outer peripheral wall of the above-mentioned honeycomb dried body by a curved surface printing machine so as to oppose each other with the central axis interposed therebetween.

Each applied portion was formed in a band shape over the entire length between both end surfaces of the dried honeycomb body (angle θ=180° central angle α=93°).

(5. Firing)

The honeycomb dried body with the electrode layer forming paste was dried at 120° C. and then degreased at 550° C. for 3 hours in the air atmosphere. Next, the honeycomb dried body with the degreased electrode layer forming paste was fired, and then oxidation treatment was carried out to prepare a honeycomb structure with electrode layers. The firing was carried out for 2 hours in an argon atmosphere at 1450° C. The oxidation treatment was carried out in the air atmosphere at 1300° C. for 1 hour. A required number of honeycomb structures with electrode layers of each test number was prepared for the following evaluation.

The honeycomb structure with electrode layers obtained under the above manufacturing conditions had circular end surfaces having a diameter of 118 mm (excluding the electrode layers) and a height (length in the direction in which the cells extend) of 65 mm. The cell density was 90 cells/cm$^2$, the thickness of the outer peripheral wall was 300 μm, the porosity of the partition walls was 45%, and the average pore diameter of the partition walls was 8.6 μm. The thickness of the electrode layer was 0.3 mm. Table 1 shows the thickness of the partition walls of each resistance region.

Further, regarding each of the arrangement of the resistance regions in the honeycomb structure portion of the honeycomb structures with electrode layers obtained under the above manufacturing conditions, L=118 mm, D1=0.05×L (5.61 mm), D2=0.05×L (5.61 mm), b/a=0.14, and d/c=0.14. The definitions of L, D1, D2, b/a, and d/c are as described above. Further, the first resistance region 110A, the second resistance region 110B, and the third resistance region 110C were formed line-symmetrically with the straight line N as the center of symmetry passing through the central axis O and perpendicular to the straight line L connecting the center of the first electrode layer 112*a* in the outer peripheral direction and the center of the second electrode layer 112*b* in the outer peripheral direction.

Since the electrical resistance per unit volume (1 cm$^3$) in the first resistance region 110A and second resistance region 110B was substantially constant in each respective region, a 3 cm$^3$ rectangular parallelepiped sample was taken from each resistance region of the honeycomb structure at an arbitrary location and measured at room temperature (25° C.) according to a four-terminal method. Further, the third resistance region 110C was classified into three regions of the central portion 110C1, the left side portion 110C2, and the right side portion 110C3, and the electric resistance per unit volume (1 cm$^3$) was substantially constant in each respective region. Therefore, the electric resistance per unit volume (1 cm$^3$) was obtained by collecting a 3 cm$^3$ rectangular parallelepiped sample from the central portion 110C1, the left portion 110C2, and the right portion 110C3 at an arbitrary location, and measuring at room temperature (25° C.) according to a four-terminal method. The results are shown in Table 1. Note that the electric resistance values shown in Table 1 are equivalent to the average values of the electric resistance per unit volume (1 cm$^3$) in each resistance region.

(6. Characteristic Evaluation)

The temperature distribution of the obtained honeycomb structure was simulated by the same method as in Test No. 1. The results are shown in Table 2.

IV. TEST NO. 14

(1. Preparation of Cylindrical Green Body)

A cylindrical green body was prepared in the same procedure as in Test No. 1 except that the diameter was different.

(2. Preparation of Honeycomb Dried Body)

The obtained cylindrical green body was formed using an extrusion molding machine having a grid-like die structure to obtain a cylindrical honeycomb formed body having a hexagonal cell shape in the cross-section perpendicular to the cell flow path direction. At the time of extrusion molding, the thickness of the partition walls at the area where the third resistance region 110C was to be formed was made thinner than the thickness of the partition walls at the area where the first resistance region 110A and the second resistance region 110B were to be formed so that a band-shaped third resistance region 110C whose vertical width in the vertical direction varied was formed right to left across the cross-section orthogonal to the direction in which the cells extend, when the cross-section orthogonal to the direction in which the cells extend was observed such that the first electrode layer 112*a* was located on the upper side and the second electrode layer 112*b* was located on the lower side, as shown in FIG. 5. Further, the arrangement of the third resistance region 110C was adjusted so that the following three regions were formed in the third resistance region 110C.

- a central portion 110C1 comprising the central axis O of the honeycomb structure portion 110,
- a left side portion 110C2 adjacent to the left end of the central portion 110C1 and extending to the left end of the third resistance region 110C and having a narrower width in the vertical direction than the central portion 110C1, and
- a right side portion 110C3 adjacent to the right end of the central portion 110C1 and extending to the right end of the third resistance region 110C and having a narrower width in the vertical direction than the central portion 110C1.

This honeycomb formed body was dried by high frequency dielectric heating and then dried at 120° C. for 2 hours using a hot gas dryer, and both end surfaces were cut by a predetermined amount to prepare a honeycomb dried body.

(3. Preparation of Electrode Layer Forming Paste)

The same electrode layer forming paste as in Test No. 1 was prepared.

(4. Application of Electrode Layer Forming Paste)

The above-mentioned electrode layer-forming paste was applied in two places on the outer surface of the outer peripheral wall of the above-mentioned honeycomb dried body by a curved surface printing machine so as to oppose each other with the central axis interposed therebetween. Each applied portion was formed in a band shape over the entire length between both end surfaces of the dried honeycomb body (angle θ=180°, central angle α=93°).

(5. Firing)

The honeycomb dried body with the electrode layer forming paste was dried at 120° C. and then degreased at 550° C. for 3 hours in the air atmosphere. Next, the honeycomb dried body with the degreased electrode layer forming paste was fired, and then oxidation treatment was carried out to prepare a honeycomb structure with electrode layers. The firing was carried out for 2 hours in an argon atmosphere at 1450° C. The oxidation treatment was carried out in the air atmosphere at 1300° C. for 1 hour. A required number of honeycomb structures with electrode layers of each test number was prepared for the following evaluation.

The honeycomb structure with electrode layers obtained under the above manufacturing conditions had circular end surfaces having a diameter of 118 mm (excluding the electrode layers) and a height (length in the direction in which the cells extend) of 65 mm. The cell density was 90 cells/cm$^2$, the thickness of the outer peripheral wall was 300 μm, the porosity of the partition walls was 45%, and the average pore diameter of the partition walls was 8.6 μm. The thickness of the electrode layer was 0.3 mm. Table 1 shows the thickness of the partition walls of each resistance region.

Further, regarding each of the arrangement of the resistance regions in the honeycomb structure portion of the honeycomb structures with electrode layers obtained under the above manufacturing conditions, L=118 mm, D1=0.05×L (5.61 mm), D2=0.05×L (5.61 mm), b/a=0.14, d/c=0.14, f/e=0.71, and g/e=0.71. The definitions of L, D1, D2, b/a, d/c, f/e, and g/e are as described above. Further, the first resistance region 110A, the second resistance region 110B, and the third resistance region 110C were formed line-symmetrically with the straight line N as the center of symmetry passing through the central axis O and perpendicular to the straight line L connecting the center of the first electrode layer 112*a* in the outer peripheral direction and the center of the second electrode layer 112*b* in the outer peripheral direction.

Since the electrical resistance per unit volume (1 cm$^3$) in the first resistance region 110A, second resistance region 110B and third resistance region 110C was substantially constant in each respective region, a 3 cm$^3$ rectangular parallelepiped sample was taken from each resistance region at an arbitrary location and measured at room temperature (25° C.) according to a four-terminal method. The results are shown in Table 1.

(6. Characteristic Evaluation)

The temperature distribution of the obtained honeycomb structure was simulated by the same method as in Test No. 1. The results are shown in Table 2.

TABLE 1

| | | Partition walls thickness (mm) | | | | | Electrical resistance (0) per unit volume (1 cm$^3$) | | | | |
|---|---|---|---|---|---|---|---|---|---|---|---|
| | Arrangement | | | Third resistance region | | | First | | Third resistance region | | |
| Test No. | of resistance region | First resistance region | Second resistance region | Left side portion | Central portion | Right side portion | resistance region (R1) | Second resistance r egion | Left side portion | Central portion | Right side portion |
| 1 | — | 0.3 (Constant regardless of location) | | | | | 2 (Constant regardless of location) | | | | |
| 2 | FIG. 3 | 0.3 | 0.3 | | 0.27 | | 2 | 1.0 × R1 | | 1.1 × R1 | |
| 3 | FIG. 3 | 0.3 | 0.3 | | 0.25 | | 2 | 1.0 × R1 | | 1.2 × R1 | |
| 4 | FIG. 3 | 0.3 | 0.3 | | 0.19 | | 2 | 1.0 × R1 | | 1.6 × R1 | |
| 5 | FIG. 3 | 0.3 | 0.3 | | 0.14 | | 2 | 1.0 × R1 | | 2.1 × R1 | |
| 6 | FIG. 3 | 0.3 | 0.3 | | 0.1 | | 2 | 1.0 × R1 | | 3.0 × R1 | |
| 7 | FIG. 3 | 0.3 | 0.3 | | 0.08 | | 2 | 1.0 × R1 | | 4.0 × R1 | |
| 8 | FIG. 3 | 0.3 | 0.3 | | 0.07 | | 2 | 1.0 × R1 | | 4.2 × R1 | |
| 9 | FIG. 3 | 0.3 | 0.3 | | 0.25 | | 2 | 1.0 × R1 | | 1.2 × R1 | |
| 10 | FIG. 3 | 0.3 | 0.3 | | 0.25 | | 2 | 1.0 × R1 | | 1.2 × R1 | |
| 11 | FIG. 3 | 0.3 | 0.3 | | 0.25 | | 2 | 1.0 × R1 | | 1.2 × R1 | |
| 12 | FIG. 3 | 0.3 | 0.3 | | 0.25 | | 2 | 1.0 × R1 | | 1.2 × R1 | |
| 13 | FIG. 4 | 0.3 | 0.3 | 0.19 | 0.25 | 0.19 | 2 | 1.0 × R1 | 1.6 × R1 | 2.1 × R1 | 1.6 × R1 |
| 14 | FIG. 5 | 0.3 | 0.3 | 0.25 | 0.25 | 0.25 | 2 | 1.0 × R1 | 2.1 × R1 | 2.1 × R1 | 2.1 × R1 |

TABLE 2

| | | | | | | | | | Temperature when energized (° C.) | | | | | | | | |
|---|---|---|---|---|---|---|---|---|---|---|---|---|---|---|---|---|---|
| Test No. | L (mm) | α (°) | D1 (mm) | D2 (mm) | b/a | d/c | f/e | g/e | t1 | t2 | t3 | t4 | t5 | Maxi-mum | Mini-mum | Maximum Temperature-Minimum Temperature | Crack evaluation |
| 1 | 93 | 100 | — | — | — | 13 | — | — | 640 | 574 | 1134 | 1098 | 695 | 1134 | 574 | 560 | C |
| 2 | 93 | 100 | 0.05 × L (4.89 mm) | 0.05 × L (4.89 mm) | — | 13 | — | — | 654 | 570 | 1103 | 1048 | 695 | 1103 | 570 | 533 | B |
| 3 | 93 | 100 | 0.05 × L (4.89 mm) | 0.05 × L (4.89 mm) | — | 13 | — | — | 662 | 565 | 1058 | 1030 | 680 | 1058 | 565 | 493 | A |
| 4 | 93 | 100 | 0.05 × L (4.89 mm) | 0.05 × L (4.89 mm) | — | 13 | — | — | 711 | 558 | 989 | 945 | 650 | 989 | 558 | 431 | A |
| 5 | 93 | 100 | 0.05 × L (4.89 mm) | 0.05 × L (4.89 mm) | — | 13 | — | — | 756 | 542 | 907 | 860 | 643 | 907 | 542 | 365 | A |
| 6 | 93 | 100 | 0.05 × ) L (4.89 mm | 0.05 × L (4.89 mm) | — | 13 | — | — | 866 | 512 | 707 | 622 | 630 | 866 | 512 | 354 | A |
| 7 | 93 | 100 | 0.05 × L (4.89 mm) | 0.05 × L (4.89 mm) | — | 13 | — | — | 948 | 480 | 571 | 560 | 662 | 948 | 480 | 468 | A |
| 8 | 93 | 100 | 0.05 × L (4.89 mm) | 0.05 × L (4.89 mm) | — | 13 | — | — | 960 | 448 | 552 | 520 | 673 | 960 | 448 | 512 | B |
| 9 | 118 | 100 | 0.13 × L (12.92 mm) | 0.13 × L (12.92 mm) | — | 13 | — | — | 653 | 625 | 1094 | 1069 | 645 | 1094 | 625 | 469 | A |

TABLE 2-continued

| Test No. | L (mm) | α (°) | D1 (mm) | D2 (mm) | b/a | d/c | f/e | g/e | Temperature when energized (° C.) t1 | t2 | t3 | t4 | t5 | Maximum | Minimum | Maximum Temperature-Minimum Temperature | Crack evaluation |
|---|---|---|---|---|---|---|---|---|---|---|---|---|---|---|---|---|---|
| 10 | 118 | 100 | 0.03 × L (2.92 mm) | 0.03 × L (2.92 mm) | — | 13 | — | — | 668 | 582 | 1048 | 1085 | 674 | 1085 | 582 | 503 | A |
| 11 | 103 | 93 | 0.10 × L (10.45 mm) | 0.10 × L (10.45 mm) | — | 13 | — | — | 642 | 603 | 1080 | 1050 | 660 | 1080 | 603 | 477 | A |
| 12 | 103 | 93 | 0.004 × L (0.45 mm) | 0.004 × L (0.45 mm) | — | 13 | — | — | 670 | 591 | 1060 | 1126 | 671 | 1126 | 591 | 535 | |
| 13 | 118 | 93 | 0.05 × L (5.61 mm) | 0.05 × L (5.61 mm) | 0.14 | 0.14 | — | — | 789 | 540 | 873 | 878 | 780 | 878 | 540 | 338 | — |
| 14 | 118 | 93 | 0.05 × L (5.61 mm) | 0.05 × L (5.61 mm) | 0.14 | 0.14 | 0.71 | 0.71 | 772 | 534 | 880 | 870 | 772 | 880 | 534 | 346 | — |

V. DISCUSSION

As can be seen from the results in Tables 1 and 2, by using the honeycomb structure (electric heating type carrier) (Test No. 2 to 14) according to the embodiment of the present invention, the heat generation uniformity was improved while the generation of cracks was suppressed. Further, by comparing Test No. 3, 9 to 11 with Test No. 12, it can be seen that by optimizing the arrangement of the first resistance region, the second resistance region, and the third resistance region, the heat generation uniformity was remarkably improved while the generation of cracks was suppressed.

DESCRIPTION OF REFERENCE NUMERALS

100: Electric heating type carrier
110: Honeycomb structure
110A: First resistance area
110B: Second resistance area
110C: Third resistance area
110C1: Central portion
110C2: Left side portion
110C3: Right side portion
110D1: Central portion
110D2: Left side portion
110D3: Right side portion
112*a*: First electrode layer
112*b*: Second electrode layer
113: Partition wall
114: Outer peripheral wall
115: Cell
116: End surface
118: End surface
119: Imaginary line
130*a*: First metal terminal
130*b*: Second metal terminal

The invention claimed is:

1. An electric heating type carrier, comprising:

a conductive honeycomb structure portion having an outer peripheral wall and partition walls that are disposed inside the outer peripheral wall and partition a plurality of cells forming flow paths from one end surface to the other end surface;

a first electrode layer provided in a band shape in a direction in which the cells extend on a surface of the outer peripheral wall; and a second electrode layer provided in a band shape in a direction in which the cells extend on the surface of the outer peripheral wall, the second electrode layer provided so as to oppose the first electrode layer with a central axis of the honeycomb structure portion interposed therebetween;

wherein in a cross-section orthogonal to the direction in which the cells extend, the honeycomb structure portion is classified into three regions of:

a first resistance region having a contact portion with the first electrode layer, a second resistance region having a contact portion with the second electrode layer, and a third resistance region that does not come into contact with either the first electrode layer or the second electrode layer, and traverses the cross-section so as to be sandwiched between the first resistance region and the second resistance region; and the third resistance region has a higher electrical resistance per unit volume (1 cm3) than an electrical resistance per unit volume (1 cm3) of the first resistance region and the second resistance region.

2. The electric heating type carrier according to claim 1, wherein in the cross-section orthogonal to the direction in which the cells extend, a shortest distance between the third resistance region and the first electrode layer is 0.02×L or more, and a shortest distance between the third resistance region and the second electrode layer is 0.02×L or more, in which L refers to a crossing length of a straight line that crosses the honeycomb structure portion when a center of the first electrode layer in an outer peripheral direction and a center of the second electrode layer in the outer peripheral direction are connected by this straight line.

3. The electric heating type carrier according to claim 1, wherein assuming an average value of the electrical resistance per unit volume (1 cm3) of the first resistance region is R1ave, an average value of the electrical resistance per unit volume (1 cm3) of the second resistance region is R2ave, and an average value of the electrical resistance per unit volume (1 cm3) of the third resistance region is R3ave, the relationship of either or both of 1.2≤(R3ave/R1ave)≤4 and 1.2≤(R3ave/R2ave)≤4 is satisfied.

4. The electric heating type carrier according to claim 1, wherein when the cross-section orthogonal to the direction in which the cells extend is observed such that the first electrode layer is located on an upper side and the second electrode layer is located on a lower side, the third resistance region is classified into three regions of:

a central portion comprising the central axis of the honeycomb structure portion, a left side portion adjacent to a left end of the central portion and extending to a left end of the third resistance region and having a lower electrical resistance per unit volume (1 cm3) than the central portion, and a right side portion adjacent to a right end of the central portion and extending to a right end of the third resistance region and having a lower electrical resistance per unit volume (1 cm3) than the central portion.

5. The electric heating type carrier according to claim 4, wherein the right end of the central portion of the third resistance region is on a more right side than a right end of the first electrode layer in an outer peripheral direction and is on a more right side than a right end of the second electrode layer in an outer peripheral direction, and the left end of the central portion of the third resistance region is on a more left side than a left end of the first electrode layer in an outer peripheral direction and is on a more left side than a left end of the second electrode layer in an outer peripheral direction.

6. The electric heating type carrier according to claim 1, wherein when the cross-section orthogonal to the direction in which the cells extend is observed such that the first electrode layer is located on an upper side and the second electrode layer is located on a lower side, the third resistance region is classified into three regions of:

a central portion comprising the central axis of the honeycomb structure portion, a left side portion adjacent to a left end of the central portion and extending to a left end of the third resistance region and having a width which is narrower in a vertical direction than the central portion, and a right side portion adjacent to a right end of the central portion and extending to a right end of the third resistance region and having a width which is narrower in the vertical direction than the central portion.

7. The electric heating type carrier according to claim 1, wherein a thickness of the partition walls of the third resistance region is smaller than a thickness of the partition walls of the first resistance region and the second resistance region.

8. The electric heating type carrier according to claim 1, comprising a slit formed by lacking a part of the partition walls of the third resistance region.

9. An exhaust gas purification device, comprising the electric heating type carrier according to claim 1, and a tubular metal tube accommodating the electric heating type carrier.

10. An electric heating type carrier, comprising:

a conductive honeycomb structure portion having an outer peripheral wall and partition walls that are disposed inside the outer peripheral wall and partition a plurality of cells forming flow paths from one end surface to the other end surface;

a first electrode layer provided in a band shape in a direction in which the cells extend on a surface of the outer peripheral wall; and a second electrode layer provided in a band shape in a direction in which the cells extend on the surface of the outer peripheral wall, the second electrode layer provided so as to oppose the first electrode layer with a central axis of the honeycomb structure portion interposed therebetween;

wherein in a cross-section orthogonal to the direction in which the cells extend, one or more slits extending in a direction intersecting an imaginary line parallel to a straight line connecting a center of the first electrode layer in an outer peripheral direction and a center of the second electrode layer in the outer peripheral direction are provided by lacking a part of the partition walls in a region sandwiched by a pair of opposing outer peripheral wall portions on a surface of which neither the first electrode layer nor the second electrode layer is provided.

11. An exhaust gas purification device, comprising the electric heating type carrier according to claim 10, and a tubular metal tube accommodating the electric heating type carrier.

* * * * *